US006882807B2

(12) United States Patent
Sakagami

(10) Patent No.: US 6,882,807 B2
(45) Date of Patent: Apr. 19, 2005

(54) FIXING DEVICE

(75) Inventor: Yusuke Sakagami, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 614 days.

(21) Appl. No.: 09/790,073

(22) Filed: Feb. 22, 2001

(65) Prior Publication Data

US 2002/0007752 A1 Jan. 24, 2002

(30) Foreign Application Priority Data

Feb. 22, 2000 (JP) ..... P.2000-043701
Feb. 22, 2000 (JP) ..... P.2000-044392
Aug. 28, 2000 (JP) ..... P.2000-256561
Aug. 28, 2000 (JP) ..... P.2000-256562
Aug. 28, 2000 (JP) ..... P.2000-256563

(51) Int. Cl.[7] ..... G03G 15/20
(52) U.S. Cl. ..... 399/69; 399/334; 219/619
(58) Field of Search ..... 219/216, 619; 399/67, 69, 70, 328, 329, 330, 331, 333, 334

(56) References Cited

U.S. PATENT DOCUMENTS 6,415,128 B1 * 7/2002 Takagi et al. ..... 399/335

FOREIGN PATENT DOCUMENTS

| | | | | |
|---|---|---|---|---|
| JP | 53-50844 | | 5/1978 | |
| JP | 53-120538 | | 10/1978 | |
| JP | 57-102676 A | | 6/1982 | |
| JP | 4-338789 A | | 11/1992 | |
| JP | 7-295414 | | 11/1995 | ..... G03G/15/20 |
| JP | 8-16005 | | 1/1996 | ..... G03G/15/20 |
| JP | 08-016006 | * | 1/1996 | |
| JP | 8-30139 A | | 2/1996 | |
| JP | 8-63022 | | 3/1996 | ..... G03G/15/20 |
| JP | 8-129313 | | 5/1996 | ..... G03G/15/20 |
| JP | 8-129315 | | 5/1996 | ..... G03G/15/20 |
| JP | 8-137306 | | 5/1996 | ..... G03G/15/20 |
| JP | 8-179647 | | 7/1996 | ..... G03G/15/20 |
| JP | 8-286534 | | 11/1996 | ..... G03G/15/20 |
| JP | 9-50199 | | 2/1997 | ..... G03G/15/20 |
| JP | 9-160413 | | 6/1997 | ..... G03G/15/20 |
| JP | 9-306652 | | 11/1997 | ..... H05B/6/02 |
| JP | 10-63126 A | | 3/1998 | |
| JP | 10-91019 | | 4/1998 | ..... G03G/15/20 |
| JP | 10-161445 | | 6/1998 | ..... G03G/15/20 |
| JP | 11-74068 A | | 3/1999 | |
| JP | 2000-181258 A | | 6/2000 | |
| JP | 2000-206814 A | | 7/2000 | |

* cited by examiner

*Primary Examiner*—Hoang Ngo
(74) *Attorney, Agent, or Firm*—Sughrue Mion, PLLC

(57) ABSTRACT

A fixing roller and a pressure roller form a nip therebetween to fix a recorded image onto a recording sheet provided into the nip. A coil provides alternating magnetic field with respect to the fixing roller to inductively heat the fixing roller. The coil includes a plurality of coil segments arranged in an axial direction of the fixing roller. The coil segments are connected in a manner of either forward connection or alternate connection. A controller determines either the forward connection or the alternate connection such that an heating efficiency due to the induction heating has a larger value.

32 Claims, 23 Drawing Sheets

FIXING DEVICE

BACKGROUND OF THE INVENTION

The present invention relates to a fixing device of a printer, and more particularly to a fixing device for an electrophotography basis printer. Further, the invention relates to a fixing device for drying a solvent contained in an ink jet printer.

There are known a fixing device which uses a halogen lamp for its heating source, and a fixing device which uses an electromagnetic induction heater for a heat source. In the related fixing device using a halogen lamp for its heating source, as shown in FIG. 29, a halogen lamp 23 cylindrical in shape is located within a fixing roller 21 hollowed, while being centered. The halogen lamp 23, when fed with current, emits an electromagnetic wave containing mainly infrared rays, and it reaches the inside of the fixing roller 21. It is converted into heat in the roller. The heat is transferred to the outside of the fixing roller 21. A recording sheet 25 bearing a marking material (toner image 24) is heated and fixed in a state that it is nipped between the fixing roller 21 and a pressure roller 22 under pressure of a spring 27. A temperature sensor 28 senses a temperature on the outside of the fixing roller 21. A temperature controller 29 controls current fed to the halogen lamp 23 in accordance with the sensed temperature, whereby a temperature of the fixing roller 21 is stabilized.

In the fixing roller 21, a core bar is shaped like a pipe, and made usually of a member of iron or aluminum family. The outer surface of the core bar is covered with a release layer for preventing an offset of the marking material. If necessary, the outer surface of the pipe-like core bar is additionally covered with an elastic layer (of a material, e.g., silicone rubber). The fixing roller, when covered with the elastic layer, is capable of pressing a toner image against the irregular surface of the recording sheet 25 under an appropriate pressure. Accordingly, toner is uniformly fused, so that the resultant picture is good in quality. A heat conductivity of the elastic layer is usually lower than that of the core bar metal. Therefore, much time is taken till a temperature on the surface of the fixing roller 21 reaches a predetermined level, and the thermal response is not good. The fixing roller 21 is supported at both ends on a structure frame by means of bearings.

The core bar of the pressure roller 22 is made of iron, stainless aluminum or the like, and its circumferential outer surface is coated with an elastic layer. In the case of the both-side printing, a release layer is applied also to the pressure roller 22. The spring 27 applies a nip load to the fixing roller 21 and the pressure roller 22, whereby those rollers form a nip.

For examples of the related printer fixing device of the type in which the electromagnetic induction heater is used as a heat source, a fixing device in which a heating coil is located within the fixing roller is disclosed in Japanese Patent Publication Nos. 8-179647A and 9-160413A.

Further, there is disclosed, in Japanese Patent Publication No. 8-129315A, a fixing device in which a core of a closed magnetic path is located passing through the fixing roller and a heating coil is located outside the fixing roller.

Still further, there is disclosed, in Japanese Patent Publication No. 8-63022A, a fixing device in which a plurality of coils are wound, and one coil develops a magnetic field whose direction is opposite to that of a magnetic field developed by its adjacent coil.

In the fixing device disclosed in Japanese Patent Publication No. 8-179647A, a magnetic flux developed by the coil feeds from the coil center and along the fixing roller. Therefore, a magnetic path formed is the sum of a length of the fixing roller and a length of the coil, and hence it is elongated. Accordingly, its reluctance is large and its magnetic density is reduced. An eddy current generated is proportional to a square of the magnetic density. Accordingly, the fixing device suffers from such a problem that an efficiency of the induction heating is reduced.

In the fixing device disclosed in Japanese Patent Publication No. 9-160413A, a bobbin and a coil wound on the bobbin are located at the central portion of the hollowed fixing roller. A magnetic flux developed by the coil feeds from the coil center and along the fixing roller. The structure of it resembles the one mentioned above, and suffers from a similar problem.

In the fixing device disclosed in Japanese Patent Publication No. 8-129315A, the fixing roller and the core form a magnetic path with a magnetic gap. The magnetic flux feeds along the fixing roller. The magnetic path formed is the sum of a length of the fixing roller and a length of the core, and hence is elongated.

In the fixing device disclosed in Japanese Patent Publication No. 8-63022A, the construction is applicable only for such a case where the coils merely adjacent to each other are arranged so as to develop magnetic fields whose directions are opposite to each other. Additionally, it is impossible to quantitatively grasp its connection difference.

Another fixing device is proposed in Japanese Patent Publication No. 8-16005A, in which a plurality of cores and coils are formed in a fixing film, and those coils are selectively used in accordance with a size of a recording sheet. However, a high frequency drive circuit and a controller are not clearly disclosed. To flow an AC current into a plurality of coils, it is necessary to select a capacitor of a resonance inverter in accordance with the inductance and resistance values of the coil. This necessitates the provision of the resonance inverter for each coil, and hence results in increase of the cost to manufacture.

Accordingly, the first object of the present invention is to increase the heating efficiency, to efficiently heat the fixing device in accordance with the width of a recording sheet, and to enhance a stability of the temperature control of a fixing roller portion which the recording sheet passes.

The following examples may be further enumerated for the related fixing device which uses the induction heater as the heat source.

There is disclosed, in Japanese Patent Publication No. 8-129313A, a fixing device in which an elastic layer and a metal sleeve are placed within a rotary heater.

There is disclosed, in Japanese Patent Publication No. 9-50199A, a fixing device which is formed with a fixing film, a coil, and a pressure roller including a core bar, an elastic layer, a heating layer, and a release layer.

Further, as is shown in FIG. 30, there is known a fixing device in which a fixing roller 31 is constructed with a metal fixing sleeve disposed around the circumferential outer surface of a holder within which a coil 33 held on a core 34.

In the fixing device disclosed in Japanese Patent Publication No. 8-129313A, a coil being wound on a U-shaped core is used for heating the metal sleeve of 10 to 15 $\mu$m. An AC magnetic field is present only near the core. Accordingly, the magnetic coupling of the coil with the metal sleeve is weak, so that the heating efficiency is small. Additionally, a portion of the metal sleeve in which the eddy current is generated by the AC magnetic field is limited to a portion of the sleeve except a portion thereof that the magnetic field enters at a right angle. Where the core is used, a region from which the magnetic field emanates is limited, and hence the heating by the eddy current is limited in its amount. This results in ineffective heating of the metal sleeve.

In a case where the heating source is a halogen lamp, only the portion of it that is irradiated with the electromagnetic wave from the halogen lamp is heated to be high in temperature, and a local rise of a surface temperature of the fixing roller tends to occur. As a result, the release layer is easy to deteriorate.

In the fixing device disclosed in Japanese Patent Publication No. 9-50199A, the fixing film and the heating layer of the pressure roller are inductively heated by the AC magnetic field developed from the coil. Of the magnetic field developed from the coil, only the magnetic field leaking from the fixing film contributes to generate the eddy current. Accordingly, the reduction of the magnetic coupling of the fixing film with the coil is the precondition in constructing the fixing device. The way of heating it from the fixing film greatly contributes to the heating of the toner since it directly contacts with the toner. However, the way to heat the pressure roller less contributes to the heating of the toner.

In the fixing device shown in FIG. 30, the pressure roller is driven to rotate, and then the flexible fixing sleeve and the holder of the coil are rotated with a frictional contact with the former. Therefore, a rotation speed difference is like to occur between the recording sheet. Accordingly, the fixed image is easy to be disarranged. Particularly in the case of high speed color printing, three color toners have been transferred to the recording sheet, slip is easy to occur between the fixing sleeve and the recording sheet. Since the coil is located within the fixing sleeve, the heat generated in the fixing sleeve and the heat generated spontaneously in the coil are confined within the fixing sleeve. Accordingly in the high speed printing, temperature rise is great.

In the related fixing device using a halogen lamp as a heating source, the fixing roller is hollowed, and it is placed therein. Accordingly, the fixing roller should be a hard roller, and the pressure roller should be a soft roller. Accordingly, the nip formed is a forward nip as shown in FIG. 31A, which causes the recording sheet to bend toward the fixing roller. In this case, the fused toner tends to stick to the fixing roller. Accordingly, the recording sheet is likely to wind itself around the fixing roller. In other words, the releasing property is poor.

Conversely, when the fixing roller is located on the upper side while the pressure roller is located on the lower side, the reverse nip is formed between them as shown in FIG. 31B. After passing through this nip, the recording sheet tends to bend downward. In this case, a force by bending the recording sheet is greater than a force at which the fused toner sticks to the pressure roller surface. Accordingly, the releasing property is good. When the nip is a horizontal nip, which is medium between the forward nip and the reverse nip as shown in FIG. 10C, the release property is good as in the case of the reverse nip.

In the case of a recording sheet being folded to be double layered, such as an envelope, the creases of the recording sheet which are formed when passing through those nips will be different. In this case, the recording sheet is double layered. Accordingly, when a curvature of the nip is large, the recording sheet is easy to be creased. To avoid the formation of the crease, it is desirable that the curvature of the nip is gentle. To secure good repeatability of the recording sheet and to prevent the crease formation of the recording sheet, it is preferable to use the horizontal nip.

Accordingly, the second object of the present invention is to reduce a rise time of heating in the fixing roller, and to enable the formation of a horizontal nip.

The following examples may be further enumerated for the related fixing device which uses the induction heater as the heat source.

There is disclosed, in Japanese Patent Publication No. 8-137306A, a fixing device in which a conductive fixing belt is used, and an electromagnetic induction coil is attached to the reverse side of the belt.

There is disclosed, in Japanese Patent Publication No. 8-286534A, a fixing device in a fixing roller is constructed with a heating member, an exciting coil and a fixing film, and the exciting coil for inductively heating the heating member is incorporated thereinto.

The fixing device disclosed in Japanese Patent Publication No. 8-137306A uses a fixing film of a small thermal capacity in order to reduce a rise time of the heating. Further, it uses two rollers, a drive roller and a tension roller, for driving it to rotate. Accordingly, the thermal capacity of those two rollers is essentially present.

The related fixing device disclosed in Japanese Patent Publication No. 8-286534A, a drive force output from the pressure roller frictionally drives a recording sheet and the fixing film to rotate. Accordingly, when the frictional force varies, a moving speed of the recording sheet and a rotational speed of the fixing film becomes instable. As a result, a frictional force present between the rotating fixing film and the fixed nip forming member also affects them. In particular at high speed rotation, the frictional force is likely to be instable.

Accordingly, the third object of the present invention is to provide a fixing device which is capable of lessening a curl of the recording sheet to surely form a substantially horizontal nip.

The following examples may be further enumerated for the related fixing device which uses the induction heater as the heat source.

There is disclosed, in Japanese Patent Publication No. 10-161445A, a fixing device in which a temperature sensor is provided on a metal thin plate, whereby a temperature sensing response and a sensing accuracy are improved.

There is disclosed, in Japanese Patent Publication No. 10-91019A, a fixing device in which a thermistor is provided near a nip portion of a fixing film, and a shielding member is provided between the thermistor and a magnetic field generator, whereby erroneous detection of temperature and erroneous operation are prevented.

In the fixing device disclosed in Japanese Patent Publication No. 10-161445A, since the temperature sensor is provided on the metal plate, a temperature sensed varies depending on a degree of the heating of the metal plate by the AC magnetic field. An object to be sensed is a temperature of the fixing roller heated by the AC magnetic field or a temperature of it coming in contact with a toner image having transferred onto a recording sheet. It is required that a temperature of the temperature sensor is closest to a temperature of the sensed object. In this connection, it is difficult to heat the metal plate and the fixing roller in the same degree by the AC magnetic field, and to radiate the equal quantities of heat from them so that they are put at the equal temperature.

In the fixing device disclosed in Japanese Patent Publication No. 10-91019A, the shielding member is made preferably of a material being conductive and having a high permeability. Such a material has also a nature that it is easily heated by the AC magnetic field. In other words, the shielding member is heated by the AC magnetic field to increase its temperature. This will lead to a temperature difference between the temperature sensor and the sensed object.

Accordingly, the fourth object of the present invention is to improve accuracy of temperature sensing.

The following examples may be further enumerated for the related fixing device which uses the induction heater as the heat source.

There is disclosed, in Japanese Patent Publication No. 7-295414A, a fixing device in which a plurality of coil segments each spirally coiled are separately arranged in the axial direction of the fixing roller, and the coil segments located on the outer side are dense in coil density, while the coils located on the inner side are coarse in coil density, in order to secure a uniform temperature distribution of the fixing roller.

There is disclosed, in Japanese Patent Publication No. 8-179647A, a fixing device in which a coil is located in a fixing roller and arranged such that both ends of the coil are located close to the fixing roller, and the central portion of the coil is located apart from the fixing roller. With such an arrangement, the eddy currents generated at both ends of the fixing roller are different from the eddy current generated in the central portion, thereby securing a uniform temperature distribution in the fixing roller.

There is disclosed, in Japanese Patent Publication No. 9-306652A, a fixing device in which a temperature distribution is equalized in the fixing roller in a manner that the fixing roller is shaped to be thick at both ends, to increase electrical resistance values there and hence the amounts of heat there.

In the fixing device disclosed in Japanese Patent Publication No. 7-295414A, however, a plurality of sheets each containing the coil segment are laminated together into a bulk, and the laminated ones are electrically interconnected, in order to array the coil segments. Accordingly, it leads the manufacturing cost up.

In the fixing device disclosed in Japanese Patent Publication No. 8-179647A, a magnetic flux flows into the heating layer of the fixing roller in the axial direction. Because of this, a flux density little varies depending on a distance between the coil and the fixing roller. This fact implies that the fixing device is less effectual in compensating for the temperature lowering at both ends.

In the fixing device disclosed in Japanese Patent Publication No. 9-306652A, an AC magnetic field of 20 to 200 kHz is applied to the heating layer. Accordingly, the AC magnetic field developed from the coil penetrates into the heating layer to such a shallow depth corresponding to a depth two to three times as long as a conductor skin thickness, since the conductor skin effect acts. Accordingly, even if a thickness of the heating layer of the fixing roller is varied, a temperature distribution is less equalized in the fixing roller.

Further, in any of the related fixing devices described above, when an iron plate of a housing or the like is located close thereto, it will be heated unless some measure is taken for preventing the AC magnetic field of the coil from leaking outside the fixing device.

As a cause of causing the non-uniform temperature distribution in the fixing roller when the fixing roller is heated by the halogen lamp or the induction heating, the heat radiated from the heat source is lost as heat loss in the form of the heat that effectively heats the fixing roller, and further the heat transferred to the bearings and the structure members and the heat diffused from the surface of the fixing roller by convection. In particular the quantity of the heat transferred to the bearings and the structure members is large. As a result of the heat loss by the heat transfer, the temperature drop is observed at both ends of the fixing roller in the profile of a temperature distribution of the fixing roller surface.

A measure having been taken for this is that a distribution of the heat from the heat source is profiled such that the heat magnitude is large at both ends of the fixing roller, thereby compensating for the heat loss by the heat transfer. Since the heat loss by the heat transfer forms the cause of making the heat distribution non-uniform, to take a measure to impede the heat transfer as well as the measure of profiling the heat distribution of the heat from the heat source is taken is a more effective way to equalize the temperature distribution in the fixing roller. However, there is not such an approach, so far as we know.

Accordingly, the fifth object of the present invention is to reduce the heat loss by the heat transfer in the fixing roller, and hence to lessen the non-uniformity of the magnetomotive force distribution in the axial direction of the fixing roller, and consequently to remove the non-uniformity of the temperature distribution in the fixing roller.

A magnetic field generator for the electromagnetic induction heating, unlike other types of heating members, does not generate heat by itself, and hence its temperature remains low as compared with that of the fixing roller to be heated. Water contained in a sheet of paper as the recording medium is evaporated when the sheet passes through the fixing device since it is heated. Therefore, the downstream end of the fixing device as viewed in the sheet transporting direction is placed in an atmosphere heavy with moisture. In this state, there is a probability that dew condensation occurs on the magnetic field generator.

Accordingly, the sixth object of the present invention is to provide a fixing device capable of reducing a probability of condensing the atmosphere into water drops on the magnetic field generator, and hence improves the durability and safety of the device.

SUMMARY OF THE INVENTION

In order to achieve the first object, according to the present invention, there is provided a fixing device, comprising:

- a fixing roller and a pressure roller, for forming a nip therebetween to fix a recorded image onto a recording sheet provided into the nip;
- a coil, for providing alternating magnetic field with respect to the fixing roller to inductively heat the fixing roller, the coil including a plurality of coil segments arranged in an axial direction of the fixing roller, and being connected in a manner of either forward connection or alternate connection; and
- a controller for determining either the forward connection or the alternate connection such that an heating efficiency due to the induction heating has a larger value.

Alternatively, the fixing device comprises a controller for changing the number of coils excited, in accordance with a size of a recording sheet provided into the nip.

In this configuration, the heating of the fixing roller by the induction heating is efficiently promoted. Accordingly, when the fixing device is applied to the printing device, a time taken from power on till the printing operation starts is reduced. Additionally, an excessive temperature rise of a fixing roller portion which the recording paper does not pass can be prevented by selecting the coil segments in accordance with the recording paper width. As a result, the temperature control of a fixing roller portion which the recording sheet passes is stabilized.

Preferably, each of the coil segments is formed by spirally coiling a litz wire.

Alternatively, the coil is formed by alternately laminating insulative sheets and coil segment layers in which each of the coil segments is formed by spirally coiling a conductive film.

Preferably, the controller includes a one-chip voltage resonating inverter.

In order to achieve the second and third objects, according to the present invention, there is provided a fixing device, comprising:

a fixing roller and a pressure roller, for forming a nip therebetween to fix a recorded image onto a recording sheet provided into the nip, the fixing roller formed by laminating a first elastic layer, a heating layer and a release layer in this order around a core bar;

a coil disposed at an outer peripheral region of the fixing roller, for providing alternating magnetic field with respect to the fixing roller to inductively heat the fixing roller;

a temperature sensor for detecting temperature of the fixing roller; and a controller for controlling the temperature of the fixing roller by adjusting alternating current supplied to the coil, in accordance with the temperature detected by the temperature sensor.

In this configuration, a heating efficiency based on the magnetic coupling of the coil with the fixing roller is 80% or higher. With the improvement, the heating efficiency is improved with a thin heating layer.

Preferably, a second elastic layer is laminated between the heating layer and the release layer.

Preferably, the heating layer is provided as a pipe member made of metal and having a thickness of 20–200 $\mu$m.

In the above configurations, the heating layer is thinned, and hence the thermal capacity is reduced, whereby a rise time of heating is reduced.

Preferably, the fixing device further comprises an auxiliary roller which is abutted against at least the fixing roller to support the nip formation of the pressure roller.

Also in this configuration, it is easy to form a substantially horizontal nip. An easy peeling of the recording sheet is secured. A recording sheet like an envelope is hard to be creased.

Preferably, the coil covers substantially more than the half of an outer periphery of the fixing roller.

Preferably, 20–100 kHz of alternating current is supplied to the coil to generate the magnetic field.

In the above configurations, the heating efficiency can be easily increased to be 80% or higher. Further, the noise generated by the resonance inverter is eliminated.

Preferably, the core bar and the heating layer of the fixing roller is electrically connected.

In this configuration, the heating layer can be prevented from floating electrically.

Preferably, the pressure roller is formed by laminating an elastic layer and a release layer in this order onto a core bar.

In this configuration, a substantially horizontal nip can be surely formed. The recording sheet is easily released from the roller. There is less probability that a special recording sheet, such as an envelope, is creased.

Preferably, a thermal capacity of the fixing roller is larger than a thermal capacity of the pressure roller.

In this configuration, a time taken for heating the pressure roller by the heat generated by the fixing roller is reduced, and hence a heating rise time is reduced.

In order to achieve the fourth object, according to the invention, it is preferable that the temperature sensor is disposed at an inner space defined by the coil while being facing with an outer surface of the fixing roller with a gap in between.

Preferably, the temperature sensor is supported by a spring member to which a treatment for suppressing eddy current generation thereon is applied.

In this configuration, the heat capacity is reduced, the rise time of the heating is shortened, and hence an accuracy of the temperature sensing by the temperature sensor is improved.

Preferably, a thickness of the spring member is 0.15 mm or less, and a width of the spring member is 1.5 mm or less.

Alternatively, the spring member is provided with a plurality of apertures.

Alternatively, the spring member is made of non-conductive material.

In the above configurations, since the generation of eddy current can be effectively suppressed, an accuracy of the temperature sensing by the temperature sensor is improved.

Preferably, the temperature sensor includes a first sensor facing a position on the fixing roller at which a recording sheet having a predetermined width passes through, and a second sensor facing a position on the fixing roller at which the recording sheet does not pass through.

Here, the controller control the temperature of the fixing roller so as to fall within a predetermined temperature range, with reference to the detected result of the first sensor. The controller lowers the temperature of the fixing roller, with reference to the detected result of the second sensor.

Specifically, the controller limits the current supplied to the coil when the temperature of the fixing roller exceeds a predetermined upper limit value, or when a rising amount of the temperature of the fixing roller exceeds a predetermined upper limit value.

Alternatively, the controller interrupts the fixing operation when the temperature of the fixing roller exceeds a predetermined upper limit value, or when a rising amount of the temperature of the fixing roller exceeds a predetermined upper limit value.

In this configuration, there can be avoided the following unwanted situation which will frequently occur in the fixing roller having a small thermal capacity: when toner images on the small-width recording sheets are successively fixed, a temperature excessively rises in the non-sheet passing portion.

In order to achieve the fifth object, according to the present invention, it is preferable that the fixing device further comprises a plurality of yokes disposed on an outer periphery of the fixing roller at a region in which an magnetomotive force of the coil is lower than a predetermined value.

Preferably, the yokes are disposed at both longitudinal ends of the fixing roller.

Preferably, each of the yokes is formed by laminating silicon steel plates.

Alternatively, each of the yokes is provided as a bulk made of soft ferrite.

In the above configurations, a heat loss by the heat transfer from the heating layer of the fixing roller to the bearings and structure members is lessened. Further, the thermal capacity of the heating layer is reduced. A flux density is increased at portions near both ends of the roller where a flux density is low, whereby an amount of heat generated there is increased.

Accordingly, a time taken for the fixing roller to be heated to a predetermined temperature is reduced. A time from a print start till the printing operation actually starts is reduced. The power consumption of the fixing device is reduced, and a temperature distribution in the fixing roller is equalized in profile. Since the yokes are disposed on the circumferential outer surface of the coil, a leakage of the AC magnetic field from the coil is prevented. Accordingly, there is no chance that the iron plate of the housing or the like is heated, and as a result, the heating efficiency of the induction heating fixing device is deteriorated.

DETAILED DESCRIPTION OF THE PREFERRED EMBODIMENTS

The preferred embodiment of the present invention will be described with reference to the accompanying drawings. A first embodiment of the invention will be discussed below.

Figure 1A:
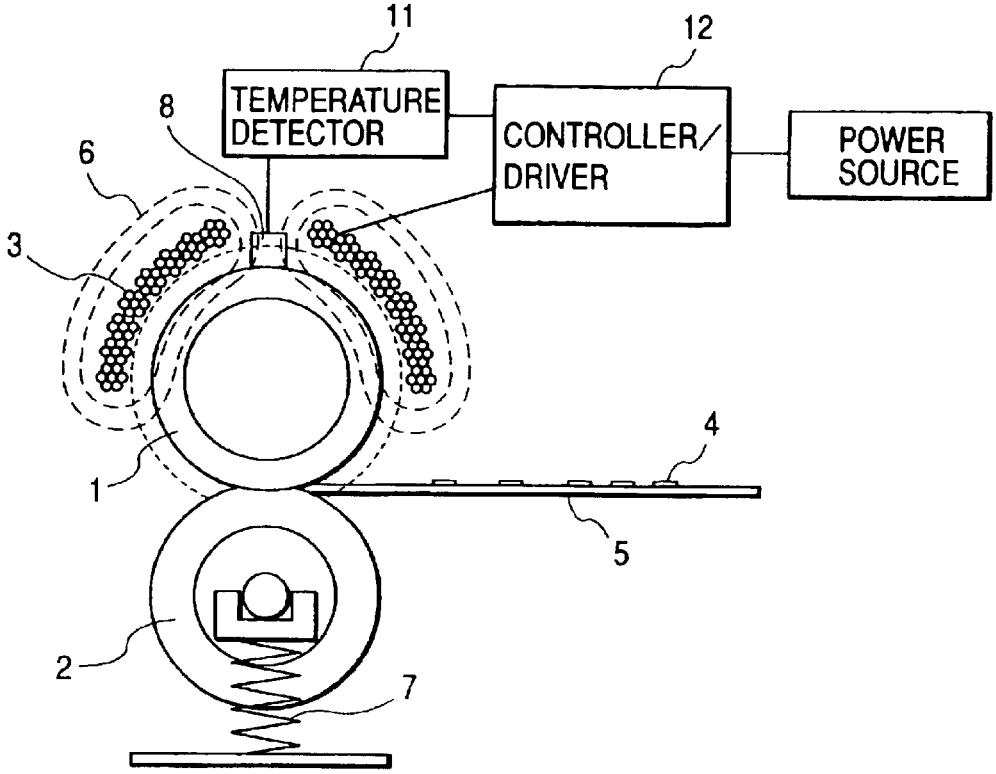
FIG. 1A is a diagram showing a schematic configuration of a fixing device according to a first embodiment of the present invention.

In FIG. 1A, a fixing roller 1 is formed with a heating layer, which is electrically conductive and small in thermal capacity, and a release layer. If necessary, an elastic layer of several tens to several hundreds $\mu$m thick is additionally layered under the release layer. The heating layer must be conductive in order to efficiently generate an eddy current therein by an AC magnetic field developed from a coil 3 (reference numeral 6 denotes a magnetic flux from the coil 3). The release layer is provided to secure an easy separation of fused toner from the fixing roller 1, viz., to prevent an offset of the toner image. A preferable material of the release layer is any of fluorine plastics (PFA, PTFE, PEP), silicone resin, fluororubber, silicone rubber and others. A thickness of the release layer is preferably within several tens to several hundreds. If it is several tens $\mu$m or thinner, it will run out by its friction with the recording sheet. If it is several hundreds μm or thicker, its thermal conductivity lowers to impede the conduction of heat from the heating layer. The fixing roller 1 includes flanges at both ends, and is rotatably supported by means of bearings, and is rotated at a fixed angular velocity by a rotational torque, which is received from a motor via gears and a belt.

Where the fixing roller 1 provided with an elastic layer is used, a sufficient nip force exerts on the irregular surface of a recording sheet 5. As a result, the image after fixed is free from an unevenness. Since a material whose thermal conductivity is low, such as silicone rubber or fluororubber, is used for making the elastic layer, a rise time of heating in the fixing roller 1 is likely to be prolonged.

A pressure roller 2 is formed with a core bar and an elastic layer. When it is used for the both-side printing, a release layer is formed on the surface thereof. It cooperates with the fixing roller 1 to make a nip therebetween with the assistance of a spring 7. A material with a sufficient strength, such as carbon steel or stainless, is suitable for the core bar. It is rotatably supported at both ends by bearings. With the assistance of the spring 7, it applies a nip load through the bearings, and follows in rotation the fixing roller 1 usually in a state that it is in friction contact with the fixing roller 1.

The recording sheet 5 having a toner image 4 transferred thereto enters the nip between rotating roller pair and receives a nip load, and at the same time it is heated by the fixing roller 1. The toner image 4 being heated is fused on the recording sheet 5. After leaving the nip, it is cooled and fixed on the recording sheet 5. Whether or not the toner image 4 is fixed on the recording sheet 5 depends on fixing temperature, sheet transporting speed, nip width, nip pressure, and nature of toner.

When the nip load generated between the fixing roller 1 and the pressure roller 2 becomes larger, the nip width therebetween becomes wider. The nip width is an important parameter to determine a fixing time. And it is determined depending a process speed of the electrophotography and a thermal nature of toner. When the nip width becomes wider, the fixing time becomes longer. If the nip load is selected to be excessively large with an intention of obtaining a long fixing time, the rotational torque is also likely to be large, thereby use of a large motor is required. This leads to increase of design limitations.

Figure 1B:
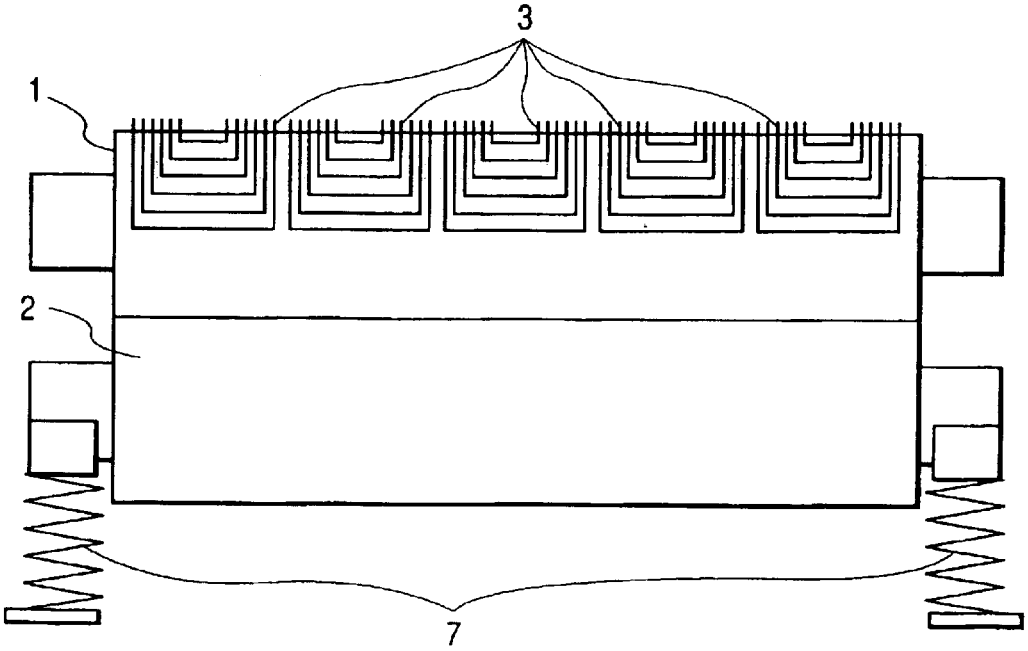
FIG. 1B is a side view of the fixing device of FIG. 1A.

The coil 3, which is for heating the fixing roller 1, is disposed around the fixing roller with a fixed gap formed therebetween. The coil 3 covers an area of the circumferential outer surface of the fixing roller 1, which is defined by the half or greater of the circumference of the fixing roller 1. FIG. 1B is a plan view showing a structure of the fixing device, which includes the fixing roller and the coil. To heat the fixing roller 1, an AC current is fed to the coil 3 and in turn the coil develops an AC magnetic field. Since a high frequency current feeds through the coil 3, a surface resistance of the coil must be small to lessen the loss by the coil. To satisfy this, a litz wire is used which is formed by twisting a bundle of insulated copper wires. A unit coil shown in FIG. 4A and a divided coil shown in FIG. 4B are formed by twisting a bundle of eight insulated copper wires of 0.5 mm in diameter (ϕ=0.5 mm), for example.

A temperature sensor 8 is held in contact with or apart from the surface of the fixing roller 1, and senses a temperature of the roller and sends it as an electrical signal to a controller/driver 12 through a temperature detector 11. When a temperature of the fixing roller 1 is lower than a control instruction temperature, the controller/driver 12 increases the AC current fed to the coil 3, whereby the induction heating is intensified to rise the temperature of the fixing roller 1. Conversely, when the former is higher than the latter, the controller/driver 12 decreases the AC current to the coil 3, and weakens the induction heating to lower the temperature of the fixing roller 1. In this way, the temperature of the fixing roller 1 is kept constant.

Figure 2A:
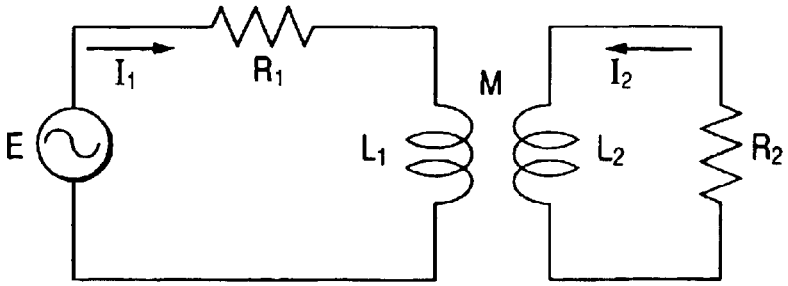
FIGS. 2A and 2B are circuit diagrams for explaining a heating efficiency.
Figure 2B:
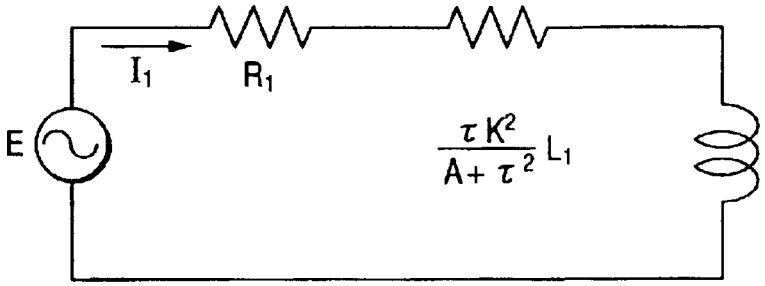

Next, an efficiency of the heating by the induction heater will be described. FIGS. 2A and 2B are circuit diagrams for explaining a heating efficiency. A state that the coil is magnetically coupled with an object to be heated (fixing roller) may be expressed in the form of an equivalent circuit as shown in FIG. 2A. A circuit equation of this circuit is given by:

$$E=(R_1+j\omega L_1)I_1-j\omega MI_2 \quad (1)$$

$$0=(R_2+j\omega L_2)I_2-j\omega MI_1 \quad (2)$$

An impedance Z3 of the circuit when viewed from the high frequency source, when arranging the expressions (1) and (2), is given:

$$Z_3=\frac{E}{I_1}=R_1+\frac{k^2\tau}{A+\tau^2}L_1+j\omega L_1\left(1-\frac{k^2\tau^2}{A+\tau^2}\right) \quad (3)$$

where, $$\tau=\frac{R_2}{L_2},\ k=\frac{M}{\sqrt{L_1L_2}},\ A=\frac{1}{\omega^2}$$

A first term of the right side of the expression (3) represents a resistance value of the heating coil, and a second term represents a resistance value of the heated object. The equivalent circuit of FIG. 2A may be rewritten into an equivalent circuit shown in FIG. 2B. When the first term of the expression (3) is placed as $R_3$, an input power $P_0$ is given by $P_0=I_1R_3$. Accordingly, a power consumed by the heated object is $P_1=I_1(R_3-R_1)$. Then, the heating efficiency η is given by the following:

$$\eta=\frac{P_1}{P_0}=\frac{R_3-R_1}{R_3} \quad (4)$$

In the above expression, $R_1$ is a resistance value of the heating coil itself and $R_3$ is a resistance value of the heating coil when it is magnetically coupled with the heated object. To compute the heating efficiency η, the resistance value $R_1$ of the coil itself is measured, the coil is attached to the fixing roller, and the resistance value $R_3$ is measured, and those measured values are substituted into the expression (4) and the expression is solved. The heating efficiency η varies depending on the frequency to be measured.

Figure 3A:
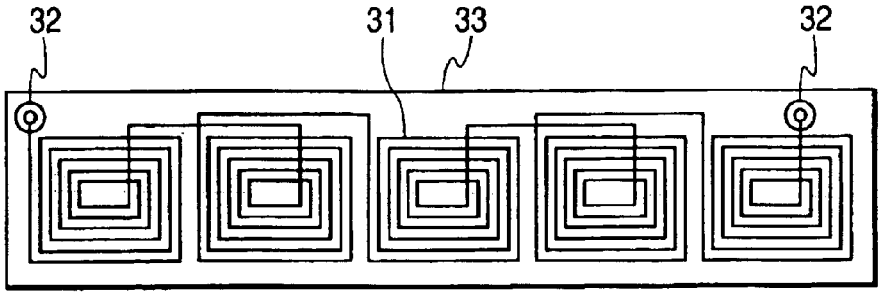
FIGS. 3A and 3B are diagrams for explaining a laminated coil.
Figure 3B:
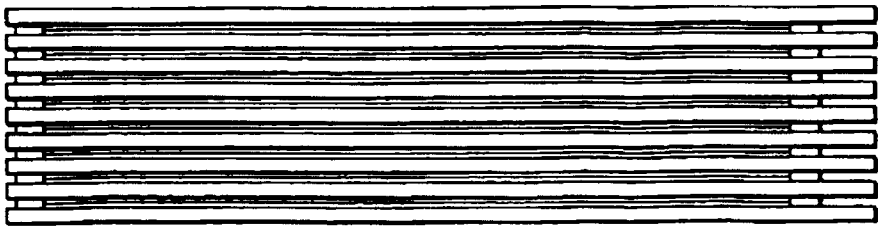

A laminated, sheet-like coil may be used for the coil 3, other than the litz coil. A conductor 31 consisting a plurality of coil segments each coiled spirally, as shown in FIG. 3A, is formed on an insulating layer 33 made of polyimide or the like, and connection pads 32 are provided at both ends of the spirally coiled conductor 31. The thus shaped conductor 31 may be formed by etching a copper foil or by pressing. A coil structure formed by laminating eight number of sheet-like coils is shown in FIG. 3B. A surface area of the conductor is eight times as large as that of one sheet of the sheet-like coil. Therefore, its surface resistance is reduced correspondingly.

Figure 4A:
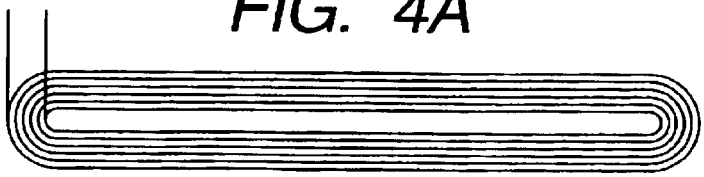
FIGS. 4A and 4B are diagrams for explaining the forms of coils.
Figure 4B:
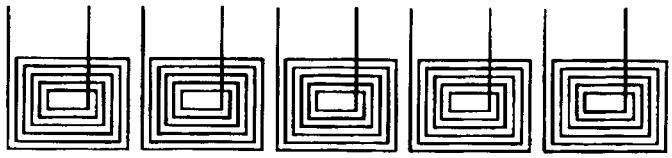

The coil may be any of a unit coil, a divided coil (forwardly connected), and another divided coil (alternately connected), those coils being equal in the number of windings (see FIGS. 4A and 4B). Inductance values L and resistance values R of those coils were measured at 10 kHz by using an LCR meter. A heating efficiency η % of each of those coils was calculated. The results of the calculations are comparatively shown in the below table. Inductance values L3 and resistance values R3 of the coils were measured when the coils are attached to the fixing roller. The gaps of the coils, which are each between the coil and the fixing roller, were equal and set at a fixed value 2.5 mm. Each of those divided coils consists of five eddied coil segments.

| | L1(μH) | R1(mΩ) | L3(μH) | R3(mΩ) | heating efficiency η |
|---|---|---|---|---|---|
| unit coil | 33.7 | 110 | 33.3 | 428 | 0.743 |
| divided coil (forward) | 29.2 | 122 | 30.1 | 534 | 0.727 |
| divided coil (alternate) | 34.5 | 122 | 36.2 | 745 | 0.836 |

As seen, the divided coil (alternate connected) exhibits the highest heating efficiency η. Thus, it is safe to say that in this case, the connection method to maximize the heating efficiency η is to alternately connect five coil segments divided as shown in FIG. 5B and to flow a high frequency current to them.

Figure 5A:
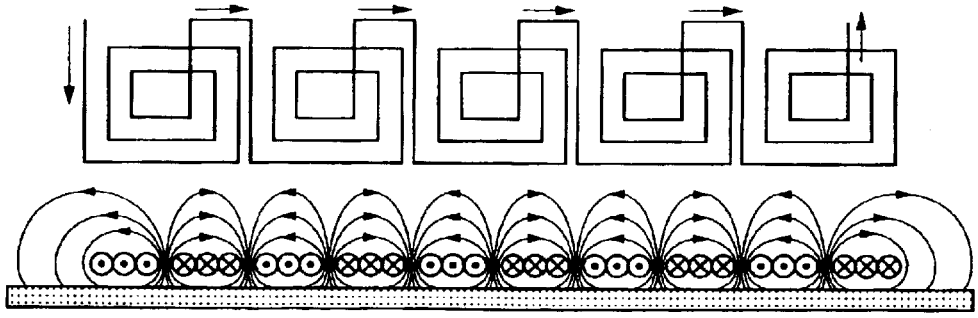
FIGS. 5A and 5B are diagrams for explaining connections of divided coils.
Figure 5B:
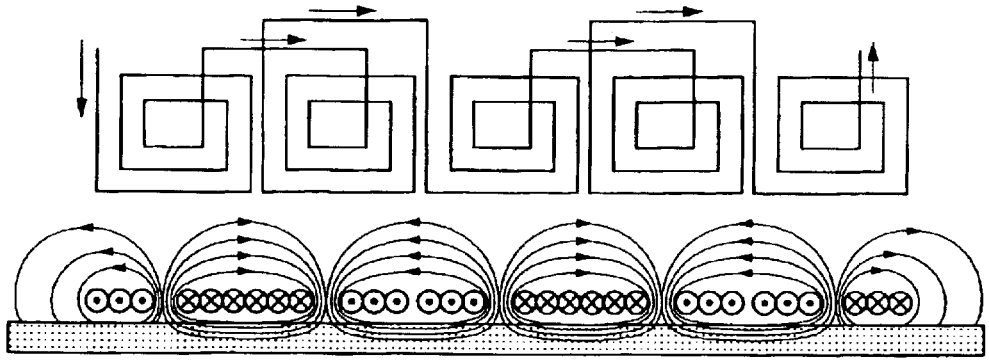

In the divided coil of the forward connection type shown in FIG. 5A, a magnetic circuit is divided into many coil segments, and a magnetic path thereof is elongated. On the other hand, in the divided coil of the alternate connection type shown in FIG. 5B, a magnetic circuit is made large, and a magnetic path thereof is shorten. The difference appears in the form of a difference of the heating efficiency η.

Even in a coil structure consisting of a plurality of complicatedly configured coil segments wound or stacked as well as the coil structure consisting of five coil segments, a connection method suitable for such a coil structure may quantitatively be found by measuring the heating efficiency η.

Figure 6:
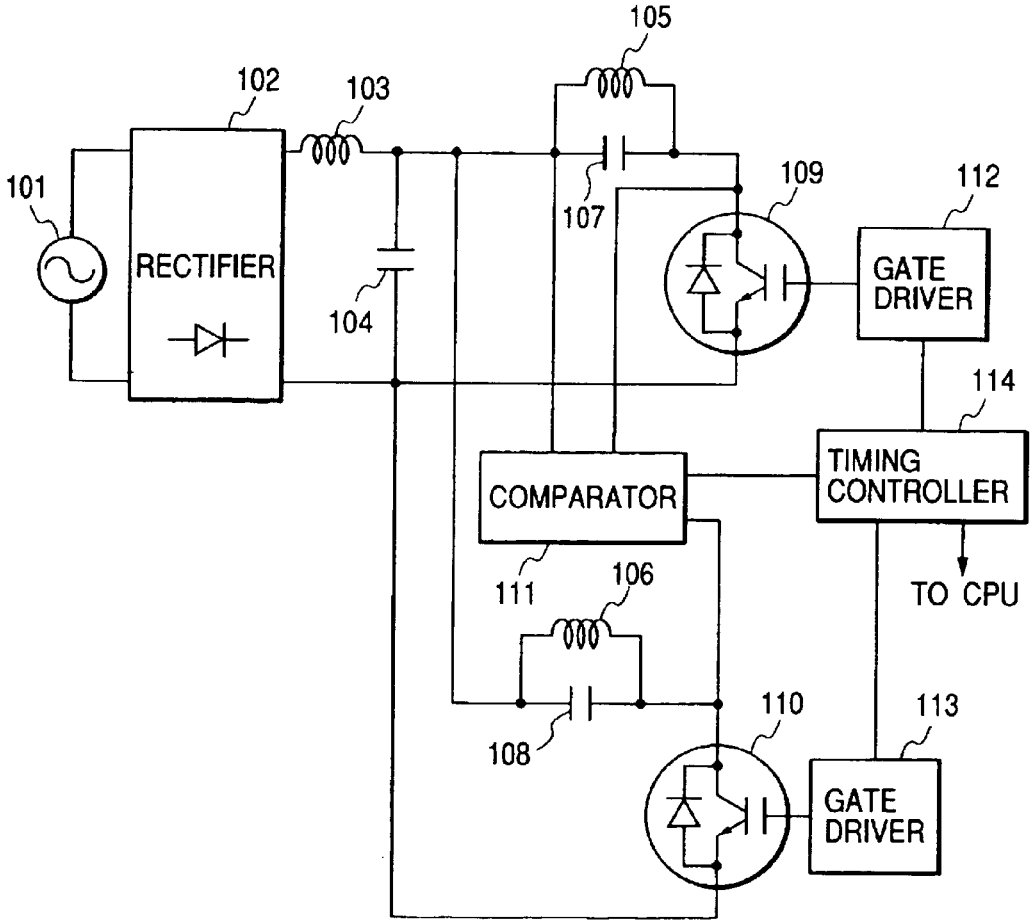
FIG. 6 is a circuit diagram showing a coil drive circuit for changing a circuit resistance in accordance with a coil selection.

Next, a coil drive circuit and a connection select circuit will be described. FIG. 6 is a circuit diagram showing a coil drive circuit for changing a circuit resistance in accordance with a coil selection.

A case where the recording sheets of the different widths are used for printing will be described. In printing recording sheets of A3 and B4 in size in the longitudinal direction, five coil segments of 70 mm wide are arranged in the axial direction of the fixing roller. To make a print on the recording sheet of the A3 size, high frequency current is fed to all the five coils to heat them. To print the recording sheet of the B4 size, high frequency current is fed to four coil segments to heat them. In this case, the values of the inductance and resistance of the coil vary in accordance with the width of the recording sheet used.

To cope with this, the high frequency drive circuit is arranged, as shown in FIG. 6, so that those values are selected in accordance with the size of the recording sheet used. As shown, the high frequency drive circuit is composed of a coil 105 corresponding to four coils, a coil 106 corresponding to the remaining one coil, resonance capacitors 107 and 108, switching elements 109 and 110, such as IGBTs, and gate drivers 112 and 113 for those switching elements. An AC power supplied from a commercial AC power source 101 is rectified by a rectifier 102, and smoothed by an inductor 103 and a capacitor 104, and a DC power is obtained. A comparator 111 detects a voltage output from each of the switching elements 109 and 110, which is near 0V, and outputs a signal for transmission to a timing controller 114. Upon receipt of the signal, the timing controller 114 applies an on/off timing signal to the gate drivers 112 and 113. In turn, the timing signal controls each resonance inverter to energize the related coil, which in turn develops an AC magnetic field. By this AC magnetic field, an eddy current is generated in the surface region of the fixing roller, and transformed into Joule heat, which heats the fixing roller.

When the recording sheet has a A3 size, the five coils are all energized for heating. Accordingly, the fixing roller is substantially entirely heated. When it is a B4 size, the four coils are energized, so that the area of the fixing roller is approximately 4/5 as large as the entire area thereof. Accordingly, it is avoided that temperature excessively rises at a portion of the fixing roller out of its portion which the recording sheet passes.

Figure 7:
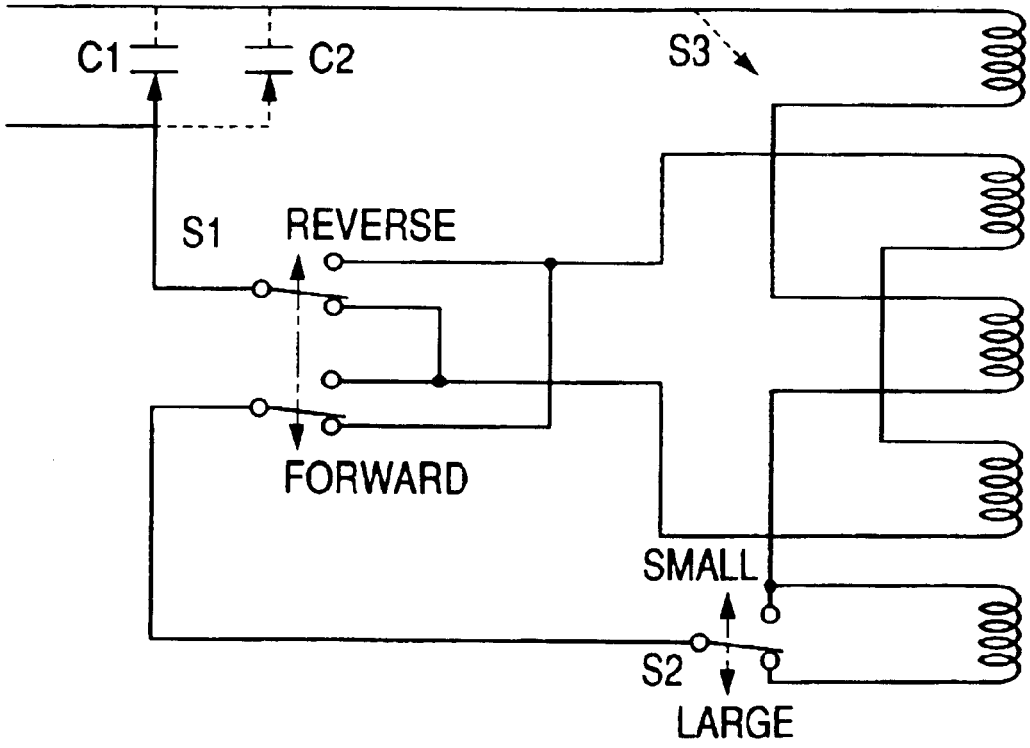
FIG. 7 is a circuit diagram showing a coil-connection select circuit.

FIG. 7 shows a circuit for switching the forward connection or the alternate connection of the divided coils, and switching the connection in accordance with the size of recording sheet. In this figure, a select switch S1 is used for selecting the forward connection or the alternate connection of the divided coil. When it is turned to a "forward" position, the five coil segments are forwardly connected. When it is turned to a "reverse" position, the five coil segments are alternately connected. A select switch S2 is used for selecting the connection of the divided coil in accordance with the size of a recording sheet. When it is turned to a "large" position, a heating circuit consisting of five coil segments is set up. When it is turned to a "small" position, the lowermost coil segment illustrated is disconnected and a heating circuit consisting of four coil segments is set up. To disconnect the coil segments on both sides of the coil array, a select switch S3, as in the case of the select switch S2, is provided. When the number of coil segments to be connected is changed and hence a resonance condition of the resonance circuit is changed, a capacitor C1 or C2 which forms the resonance circuit is selected.

It should be understood that the present invention is not limited to the above-mentioned embodiment, but may variously be modified, altered and changed within the true spirits of the invention. As described above, in the embodiment mentioned above, a plurality of coil segments, which are arranged in the axial direction of the fixing roller, are connected forwardly or alternately, whereby the heating efficiency is maximized. If required, those coil segments may be stacked one on another.

A second embodiment of the present invention will be discussed below.

Figure 8A:
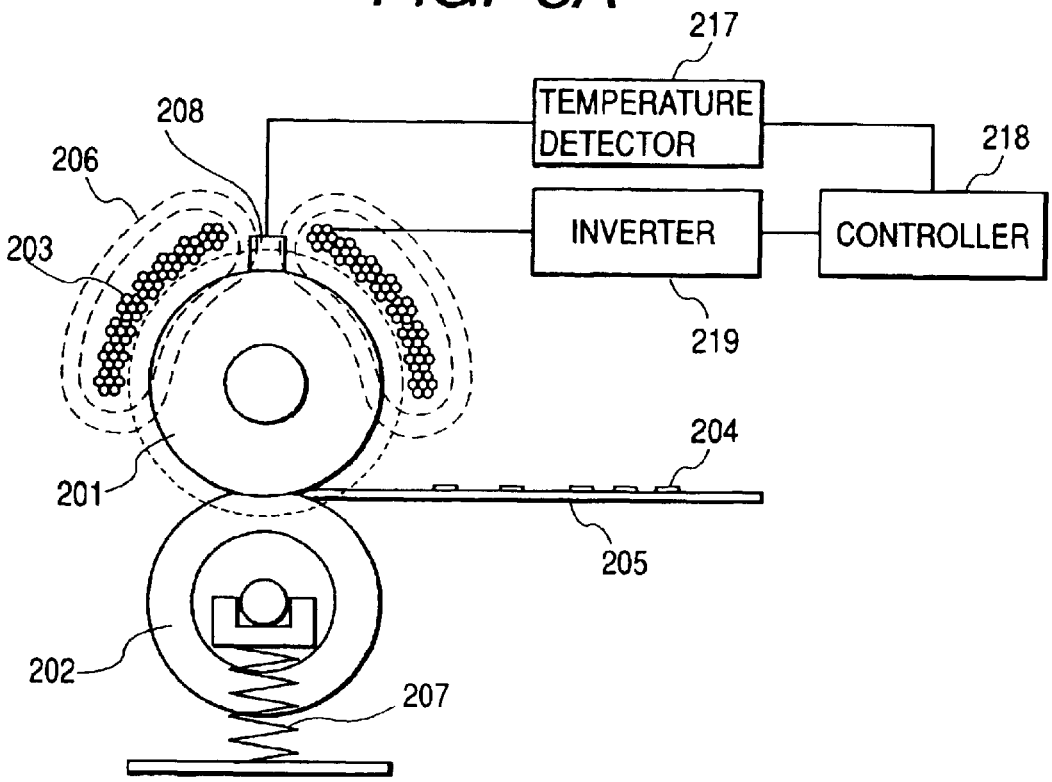
FIG. 8A is a diagram showing a schematic configuration of a fixing device according to a second embodiment of the present invention.

In FIG. 8A, a fixing roller 201 includes a core bar which enables the fixing roller to rotate, and is rotatably supported at both ends by means of bearings. A rotational torque from a motor is transmitted to the fixing roller by way of gears and a belt, and in turn is rotated at a fixed angular velocity. An elastic layer for forming a nip is layered on the circumferential outer surface of the core bar. A heating layer and a release layer are further layered on the circumferential outer surface of the elastic layer. A pressure roller 202 is formed with a core bar and an elastic layer. When it is used for both-side printing, a release layer is formed on the surface of the pressure roller. The pressure roller is confronted with the fixing roller 201 and pressed by the spring 207 to form a nip between them, and follows in rotation the fixing roller 201 with a frictional contact therebetween. The detailed structure of the fixing roller 201 and the pressure roller 202 will be discussed later.

A recording sheet 205 bearing toner image 204 transferred thereto enters the nip between the rotating roller pair, and receives a nip load while at the same time it receives heat from the fixing roller 201. The toner image 204 is fused, by the heating, on the recording sheet 205. The toner image 204 leaves the nip and cooled, and fixed on the recording sheet 205. Whether or not the toner image 204 is fixed on the recording sheet 205 depends on fixing temperature, sheet transporting speed, nip width, nip pressure, and nature of toner.

Where the nip load generated between the fixing roller 201 and the pressure roller 202 becomes larger, the nip width therebetween becomes wider. The nip width is an important parameter to determine a fixing time. And it is determined depending a process speed of the electrophotography and a thermal nature of toner. Where the nip width becomes wider, the fixing time is prolonged. If the nip load is selected to be excessively large with an intention of obtaining a long fixing time, the rotational torque is also likely to be large, thereby use of a large motor is required. This leads to increase of design limitations.

A coil 203, which is for heating the fixing roller 201, is disposed around the fixing roller with a fixed gap formed therebetween. To heat the fixing roller 201, an AC current is fed to the coil 203 and in turn the coil develops an AC magnetic field. The coil 203 covers an area of the circumferential outer surface of the fixing roller 201, which is defined by the half or greater of the circumference of the fixing roller.

Figure 8B:
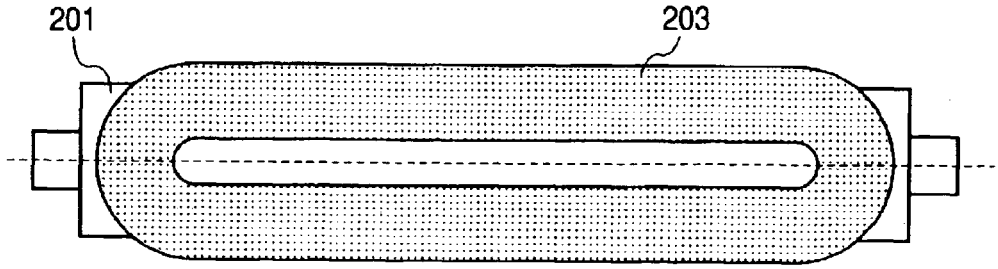
FIG. 8B is a top plan view showing a fixing roller and a coil in the fixing device of FIG. 8A.
Figure 8C:
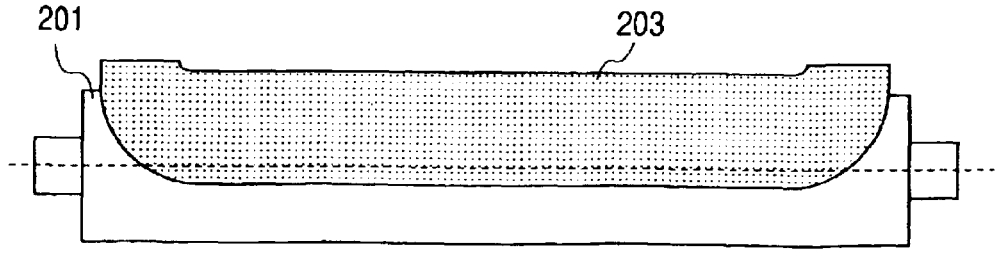
FIG. 8C is a side view of FIG. 8B.

FIG. 8B is a plan view showing a structure of the fixing roller 201 and the coil 203. FIG. 8C is a side view of the same. Since a high frequency current flows through the coil 203, a surface resistance of the coil must be small to lessen the loss by the coil. To satisfy this, a litz wire is used which is formed by twisting a bundle of insulated copper wires. It is formed by twisting a bundle of eight insulated copper wires of 0.5 mm in diameter ($\phi$=0.5 mm), for example.

The fixing roller 201 is heated such that an AC magnetic field developed from the coil 203, which is spaced from the fixing roller by the predetermined gap, is applied to the fixing roller 201, to generate an eddy current in the conductive heating layer. In this case, the AC magnetic field from the coil 203 concentrates mainly in the surface region of the fixing roller 201 because of the conductor skin effect. Assuming that an electric resistivity is $\rho$, a magnetic permeability is $\mu$, a frequency of the AC magnetic field is f, and a thickness of the skin of the roller is $\delta$, then we have:

$$\delta = \sqrt{\frac{\rho}{\pi f u}}$$

When a frequency f of the AC magnetic field developed from the coil 203 is appropriately selected to efficiently heat the roller, a magnetic flux 206 from the coil 203 concentrates in a surface region of the roller defined by a conductor skin thickness $\delta$, so that an eddy current is effectively generated therein. Upon generation of the eddy current, Joule heat is produced depending on an electric conductivity $\rho$ and a temperature of the fixing roller 201 rises. The conductor skin thickness $\rho$ is approximately several tens $\mu$m to 120 $\mu$m under the condition that a material of the roller is carbon steel, SUS304, SUS430 or the like, and the frequency f of the AC magnetic field is 25 kHz.

To reduce the thermal capacity of the heating layer, it is better to reduce a thickness of the heating layer as thin as possible. If it is too thin when comparing with the conductor skin thickness, the heating efficiency reduces. Accordingly, a compromise between them is required.

The temperature sensor 208 is held in contact with or apart from the surface of the fixing roller 201 by a fixed distance, and senses a temperature of the roller, and sends it as an electrical signal to a controller 218 through a temperature detector 217. When a temperature of the fixing roller 201 is lower than a control instruction temperature, a controller 218 increases the AC current fed to the coil 203 through the control of an inverter 219, whereby the induction heating is intensified to rise the temperature of the fixing roller 201. Conversely, when the former is higher than the latter, the controller 218 decreases the AC current to the coil 203, and weakens the induction heating to lower the temperature of the fixing roller 201. In this way, the temperature of the fixing roller 201 is kept substantially constant.

Figure 9A:
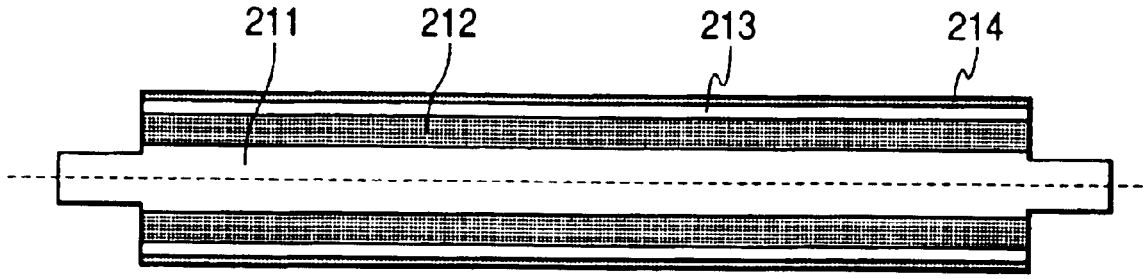
FIGS. 9A to 9C are diagrams showing examples of the fixing roller.
Figure 9B:
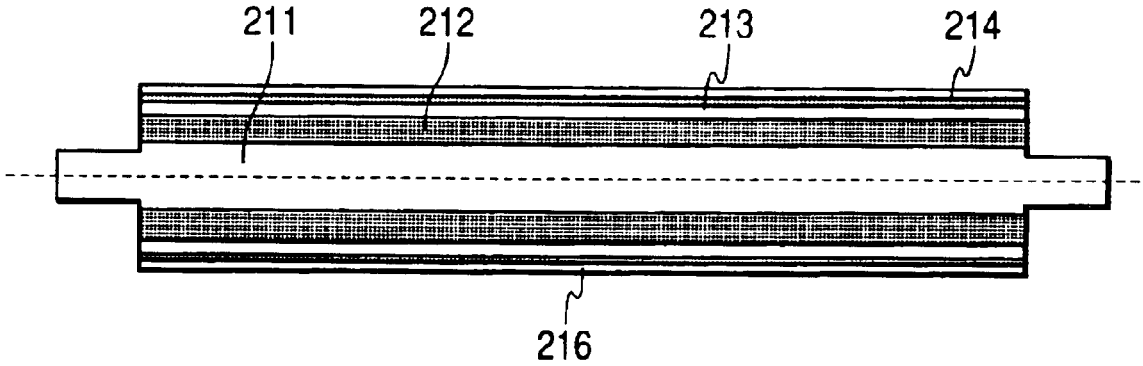

The fixing roller 201, as shown in FIG. 9A, is formed with a core bar 211, an elastic layer 212, a heating layer 213 which is conductive and has a small thermal capacity, and a release layer 214. If necessary, a first elastic layer 215, as shown in FIG. 9B, is layered on the underside of the heating layer 213, and a second elastic layer 216 is layered on the underside of the release layer 214. The fixing roller 201, which includes the second elastic layer 216 shown in FIG. 9B, applies a sufficient nip force to the toner even if the surface of the recording sheet 5 is irregular. Accordingly, the toner layer after fused is firmly fixed on the recording sheet 5 even if its surface is irregular. The picture after fixed is free from an unevenness. The FIG. 9A structure of the fixing roller does not include the second elastic layer 216. Accordingly, a plurality of concavities, after fixing, are observed on the toner layer surface, while corresponding to the concavities of the recording sheet. Accordingly, the FIG. 9B structure is higher in cost than the FIG. 9A structure, but the obtained image quality is improved. Thus, the fixing roller 201 has such a function separation structure that the core bar 211 is designed to have a strength substantially equal to a strength required for the rotary body, and the heating function is assigned to the heating layer 213.

A material of good strength, such as carbon steel or stainless, is suitable for the core bar 211. A material suitable for the elastic layer 212 is resistive to heat generated by the fixing operation, and has an appropriate elasticity suitable for forming the nip between the fixing roller and the pressure roller. Examples of such a material are silicone rubber, expanded silicone rubber, fluororubber, expanded fluororubber and others. The second elastic layer 216, which is located under the release layer 214 and between it and the heating layer 213, is approximately several tens to several hundreds $\mu$m.

In connection with the formation of a nip, to secure a predetermined nip width and to form a horizontal nip, it is required that the fixing roller and the pressure roller are both deformable appropriately. In the fixing roller which is heated from the inside as in the case of using the halogen lamp as a heating source, a structure that the elastic layer is located on the inner side of the heating layer, if employed, impedes the conduction of heat from the halogen lamp. To avoid this, the related technique has employed the following structure of the fixing roller: the elastic layer which gives the fixing roller an appropriate elasticity is provided on the outer side of the heating layer. However, in this structure, since the heat conduction of the elastic layer located radially on the outer side is not good, it is difficult to quickly transfer heat from the heating layer to the release layer as an outermost layer.

The electromagnetic induction heating is capable of efficiently heating the object also from the outside. Accordingly, the structure of the fixing roller which has an elasticity as shown in FIGS. 9A or 9B may be employed when the electromagnetic induction heating is used. In the structure, the heating layer is a metal pipe of a thin thickness. A material being easily deformable, such as silicone rubber or expanded silicone rubber, may be used for the elastic layer. Accordingly, both the fixing roller and the pressure roller may be designed to have an appropriate elasticity, and a substantially horizontal nip may be formed therebetween.

An eddy current is efficiently generated in the heating layer 213 by an AC magnetic field developed from the coil 203. Accordingly, it must have a conductivity property. Therefore, the thermal capacity becomes smaller, the rise time becomes shorter. A proper frequency of the AC magnetic field is determined by an electric resistivity and a magnetic permeability of the heating layer. When the frequency is excessively high, the loss of the switching element of the resonance inverter is large. Accordingly, it is preferable within a range of 20 to 100 kHz. The frequency of 20 kHz or lower, if so selected, falls within an audible range of the frequency. In this case, noise generated from the resonance inverter is audible. The AC magnetic field developed from the coil 203 penetrates into the heating layer 213 by a shallow depth of its conductor skin thickness since the conductor skin effect acts. The heating layer 213 is formed with a metal pipe having a thin thickness, which is made of stainless, iron, nickel, aluminum or the like. A material of a small thermal capacity, if used, reduces the heating rise time. A thickness of the heating layer 213 also affects the nip formation. The heating layer, if too thick, is hard to be bent. Accordingly, it is suggestible that the heating layer is selected to be thin to such an extent as to have a sufficient nip width. It is essential that the heating layer 213 has an appropriate elasticity to form a proper nip. If it is several tens $\mu$m or less, its durability deteriorates. In contract with this, if it is several tens $\mu$m or greater, its elasticity property is lost. For this reason, a thickness of the heating layer is preferable within a range of 30 to 100 $\mu$m, allowing for a conductor skin thickness.

The release layer 214 is provided as the outermost layer to secure an easy separation of fused toner from the fixing roller, viz., to prevent an offset of the toner image. A preferable material of the release layer 214 has a small surface energy, and is flexible, and examples of such a material are fluorine plastics (PFA, PTFE, PEP), silicone resin, fluororubber, silicone rubber and others. A thickness of the release layer is preferably within a range of 5 to 100 $\mu$m. If it is 5 $\mu$m or thinner, it will run out by its friction with the recording sheet. If it is 100 $\mu$m or thicker, heat from the heating layer cannot be transferred efficiently since a thermal conductivity of the material suitable for the release layer is small as described above. That is, a relatively long time is taken for the transfer of heat from the heating layer.

Figure 9C:
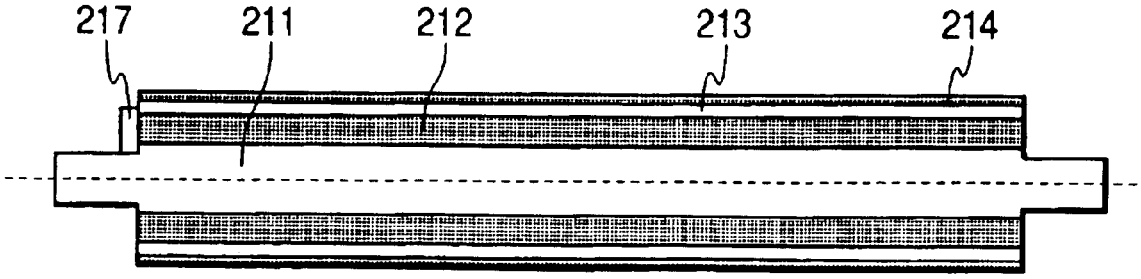

The elastic layer 212 is made of silicone rubber, expanded silicone rubber, fluororubber, expanded fluororubber and others, and hence has frequently an insulating property. Accordingly, the heating layer 213 of the fixing roller is not electrically connected to the core bar 211. For this reason, the core bar 211 is electrically connected to the housing via the bearings. On the other hand, the heating layer electrically floats. Accordingly, when friction occurs, charges are stored in stray capacitors, so that the temperature sensor possibly suffers from noise generated. To avoid this, as shown in FIG. 9C, the heating layer 213 is electrically connected to the core bar 211 by the connection member 17, whereby preventing the heating layer 213 from floating. Another electrical connection of the heating layer 213 to the core bar 211, which does not use a connection member 217 and may be employed, is such that conductive fine particles of carbon or the like are dispersed into the elastic layer 212 to reduce electrical resistance thereof.

Where a thickness of the heated object is sufficiently larger than a conductor skin thickness thereof, an AC magnetic field transforms into a leak current within the heated object. Therefore, the heating efficiency tends to be high. When the thickness of the heated object is substantially equal to or 2 to 3 times as large as the conductor skin thickness, the coil must be designed so as to increase the heating efficiency.

Figure 10A:
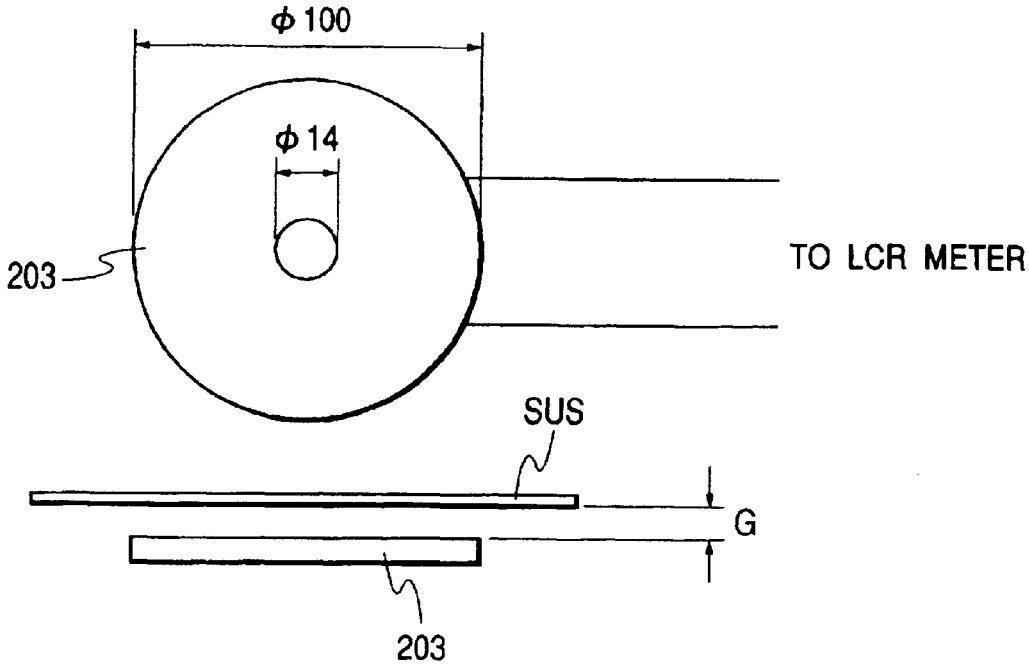
FIGS. 10A and 10B are diagrams for explaining the measurement of the heating efficiency.
Figure 10B:
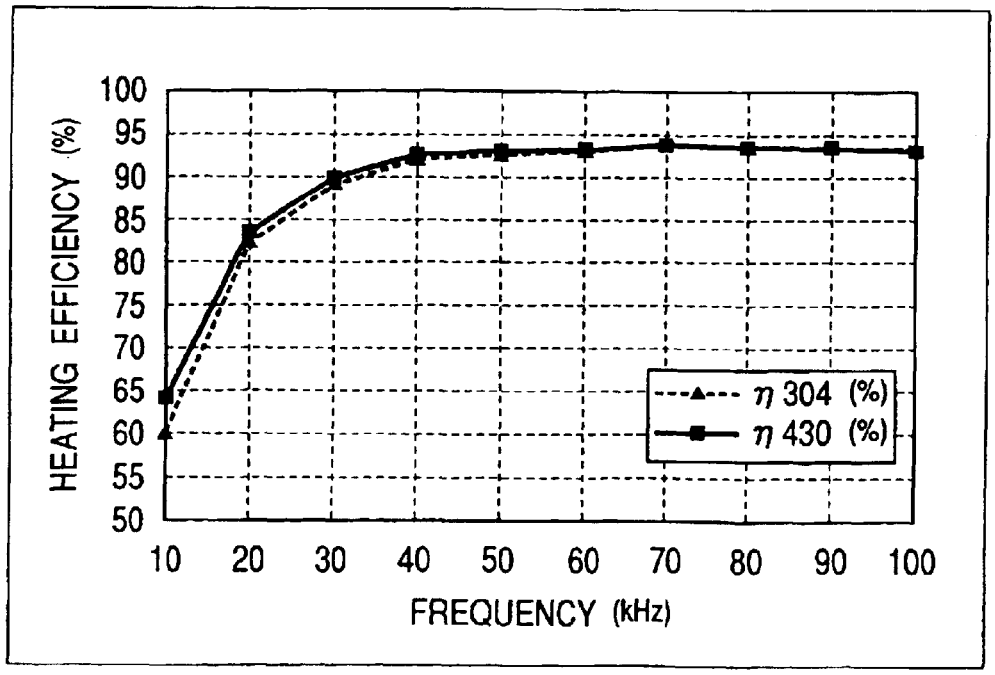

The heating efficiencies $\eta$ of plates SUS304 and SUS430 and a plane coil shown in FIG. 10A were actually measured, and the results are shown in FIG. 10B.

(1) samples: SUS304 (W 150 mm; D 150 mm; H 0.1 mm)
SUS430 (W 150 mm; D 150 mm; H 0.1 mm)

(2) plane coil: litz wires ($\phi$0.5 mm, 8 wires twisted, 15 T),
outer diameter: $\phi$100 mm
inner diameter: $\phi$14 mm (3) gap G between the SUS plate and the plane coil: 3.3 mm (4) instrument: impedance/gain phase analyzer (4194A by Hewlett-Packard Company)

The measurement results of the heating efficiency vs. frequency are shown in FIG. 10B. The measurement results show that when the SUS plate of 0.1 mm thick is inductively heated, the frequency of the resonance inverter used must be approximately 30 kHz or higher, in order to obtain the heating efficiency of 90% or higher.

Figure 11:
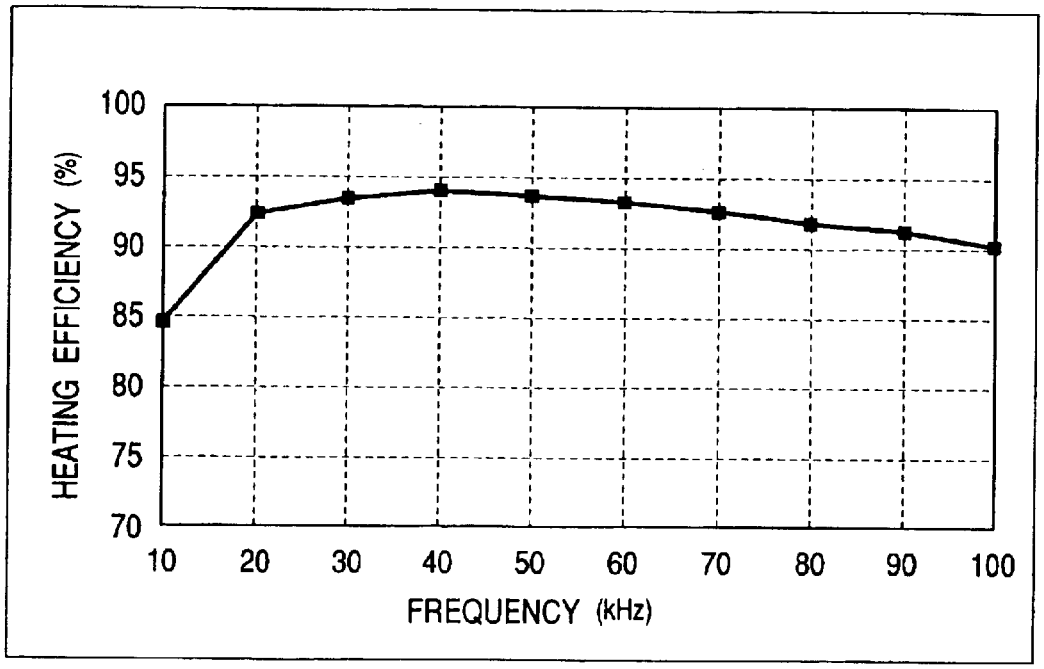
FIG. 11 is a graph showing the heating efficiency of the fixing roller and the coil.
Figure 12A:
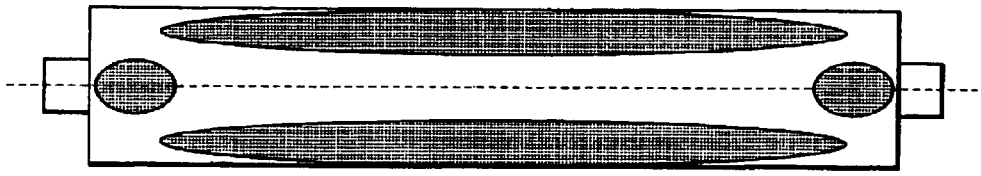
FIGS. 12A and 12B are diagrams for explaining a distribution of eddy current generated in the fixing roller.
Figure 12B:
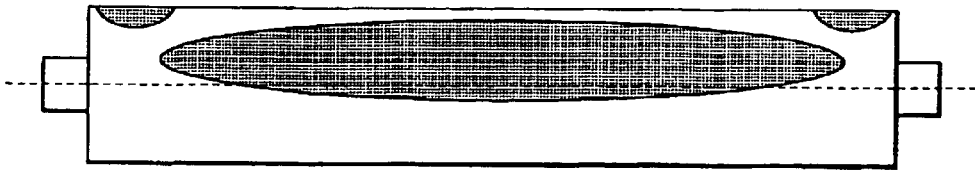

A heating efficiency based on the magnetic coupling of the fixing roller with the coil was measured, and the result of the measurement is shown in FIG. 11. An eddy current distribution of the structure of FIG. 8B is shown in FIG. 12A, and an eddy current distribution of the same of FIG. 8C is shown in FIG. 12B. The core bar of $\phi$12 mm was made of carbon steel. The elastic layer was made of expanded silicone rubber. The heating layer was an Ni electrocasted tube of 70 $\mu$m. The release layer was a PFA tube of 30 $\mu$m. In this case, the heating efficiency was 80% or higher at any frequency, as the result of the magnetic coupling of the coil with the core bar and the heating layers.

Figure 13A:
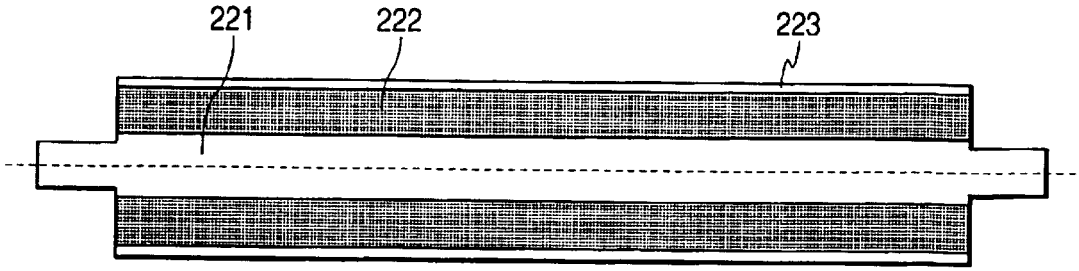
FIG. 13A is a diagram showing an inner structure of a pressure roller in the present fixing device.

The pressure roller 202 is constructed such that, as shown in FIG. 13A, an elastic layer 222 is layered on the circumferential outer surface of a core bar 221, and a release layer 223 is further layered thereon. The core bar 221 is made mainly of iron or its family, and serves as a shaft for rotatably supporting the pressure roller 202. The elastic layer 222 is required to have a thermal resistance that is high enough to resist the fixing temperature, and further an elasticity suitable for forming a nip between it and the fixing roller. Such a material is silicone rubber, fluororubber or the like. To reduce the thermal capacity of the pressure roller 202, it is better that any of those rubbers is foamed to have a heat insulating property. The release layer 223 is the same as the release layer 214 of the fixing roller 201.

Figure 13B:
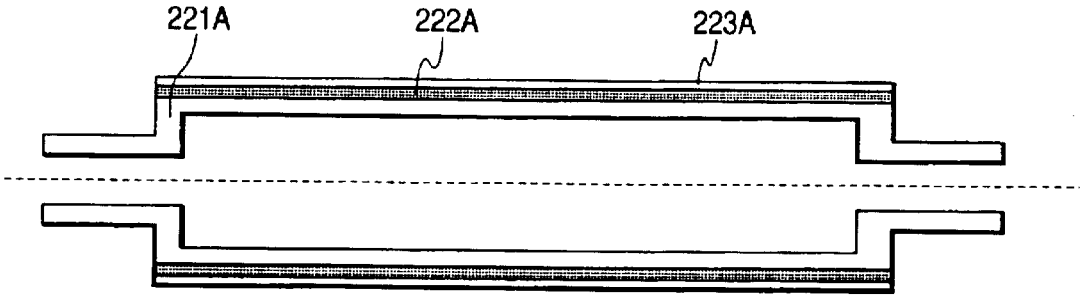
FIG. 13B is a diagram showing an inner structure of a related pressure roller.

A structure of the related pressure roller is shown in FIG. 13B. As shown, an elastic layer 222A is layered on the outer surface of a core bar 221A hollowed, and a release layer 223A is further layered thereon. The core bar 221A is made of a member of iron family (carbon steel, stainless and the like) or aluminum, and serves as a shaft of the pressure roller while being rotatably supported. A thickness of the core bar 221A is usually about 1 to 3 mm, and has a large heat capacity. The elastic layer 222A is required to have a durability high enough to resist the fixing temperature, and further to have an elasticity appropriate to the formation of a nip defined by it and the fixing roller. The release layer 223A is substantially the same as of the fixing roller.

Figure 14:
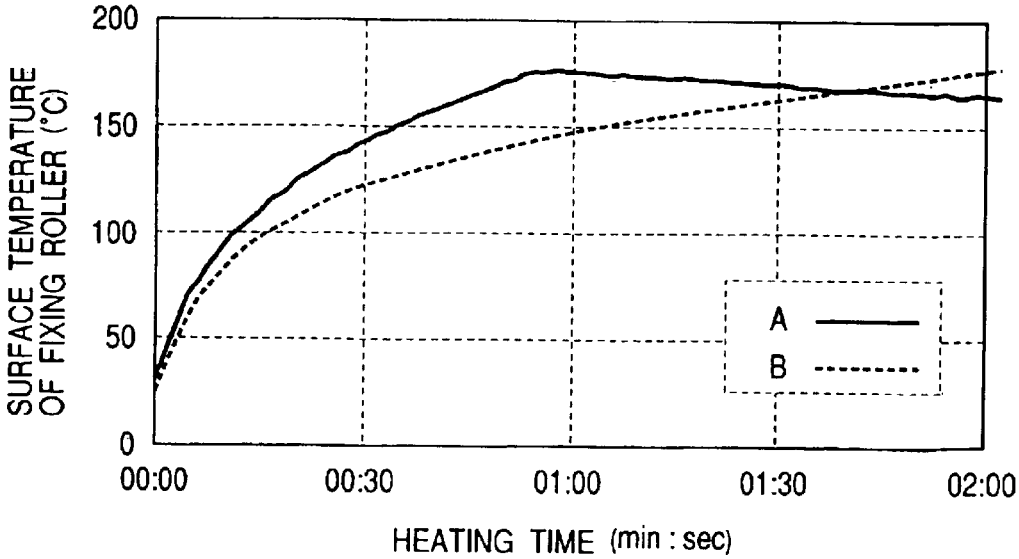
FIG. 14 is a graph comparatively showing heating rise times of different fixing rollers, which were gathered by an experiment.

FIG. 14 is a graph comparatively showing heating rise times of different fixing rollers, which were gathered by an experiment. A pressure roller A had a structure shown in FIG. 13A constructed according to the invention. A weight of it was approximately 470 g. A pressure roller B having the structure of FIG. 13B was used and its weight was approximately 720 g. The heating rise time was a time taken for a surface temperature of the fixing roller to reach 150° C. When comparing the rise time of the pressure roller A with that of the pressure roller B, it is seen that the heating rise time of the related pressure roller B is about two times as long as the heating rise time of the pressure roller A of the invention.

Figure 15:
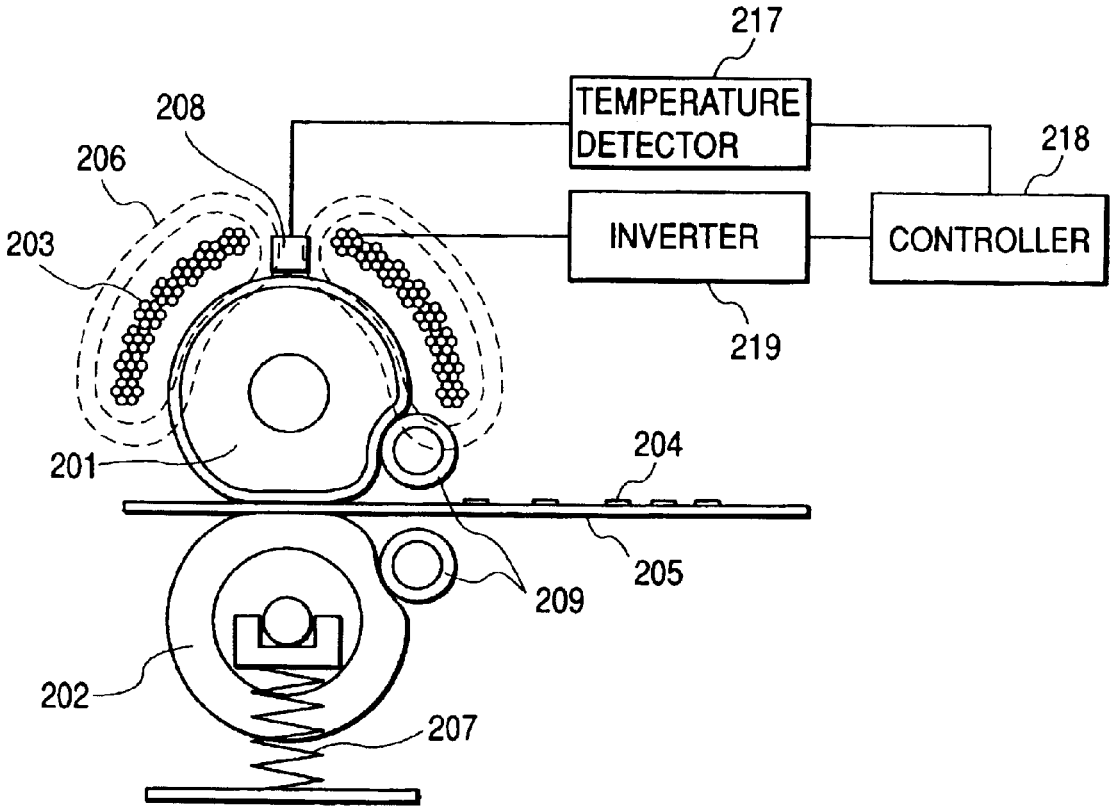
FIG. 15 is a diagram showing a schematic configuration of a fixing device according to a third embodiment of the present invention.

FIG. 15 shows a fixing device capable of easily forming a horizontal nip, which is a third embodiment of the invention. An auxiliary roller pair 209 is in contact with a pair of a fixing roller 201 and a pressure roller 202 at a position located upstream of a pair of a fixing roller 201 and a pressure roller 202, and in this state assists the fixing and pressure rollers in forming a nip therebetween. The auxiliary roller pair 209 may also be designed so as to assist the fixing and pressure rollers in the nip formation in a state that the roller pair is in contact with at least the fixing roller 201.

It should be understood that the invention is not limited to the above-mentioned embodiments, but may variously be modified, altered and changed within the true spirits of the present invention.

In the fixing device of the invention, the fixing roller has a structure which includes a thin metal heating layer which reduces its thermal capacity and a rise time of heating, a core bar, an elastic layer having also an insulation property, and a release layer layered on the surface of the structure. An eddy current is generated in the heating layer by an AC magnetic field developed from the coil. An eddy current is generated in the heating layer by an AC magnetic field developed from the coil.

In this case, the heating layer is thin so as to establish a conductor skin effect. The thus constructed structure improves the heating efficiency based on the magnetic coupling of the heating layer with the coil. Accordingly, the fixing roller is efficiently heated. Further, the coil is disposed covering the fixing roller, to thereby obtain 80% or higher of the heating efficiency based on the magnetic coupling of the heating layer with the coil. In this case, if the heating layer is thick, the magnetic coupling of it with the coil is easily secured. If it is thin, its location relative to the heating layer is an important factor in design.

The configuration discussed in connection with the second and third embodiments can be applied to the configuration according to the first embodiment.

A fourth embodiment of the present invention will be discussed below.

Figure 16A:
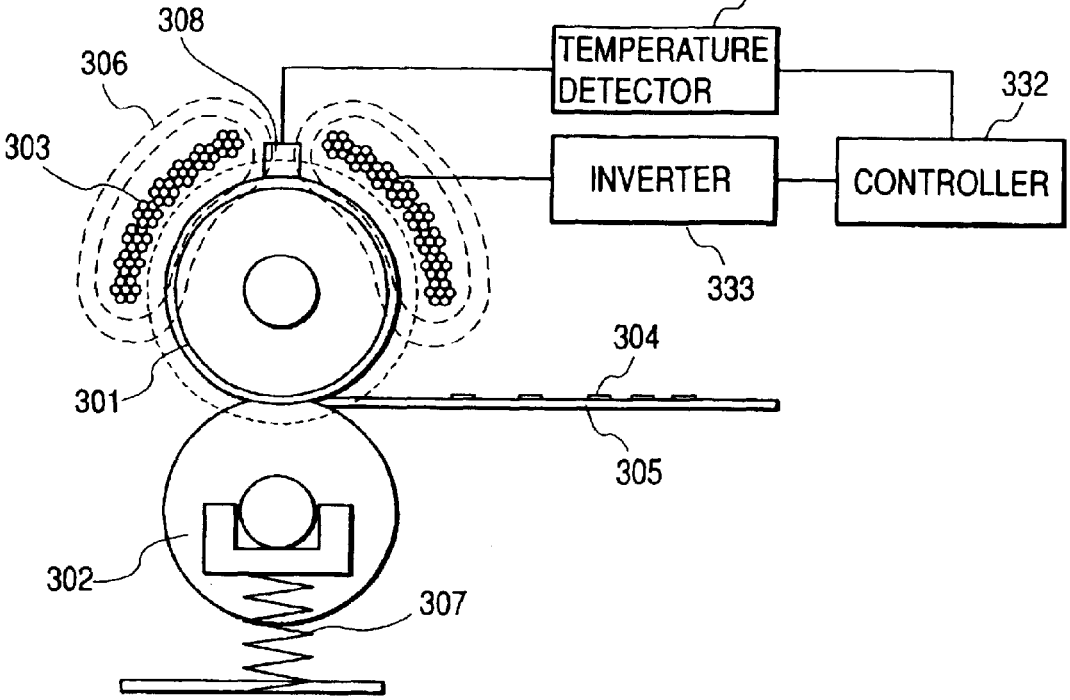
FIG. 16A is a diagram showing a schematic configuration of a fixing device according to a fourth embodiment of the present invention.

In FIG. 16A, a fixing roller 301 includes a core bar which enables the fixing roller to rotate, and is rotatably supported at both ends by means of bearings. A rotational torque from a motor is transmitted to the fixing roller 301 by way of gears and a belt, and in turn is rotated at a fixed angular velocity. An elastic layer for forming a nip is layered on the circumferential outer surface of the core bar. A heating layer and a release layer are further layered on the circumferential outer surface of the elastic layer. A pressure roller 302 is formed with a core bar, and an elastic layer and a release layer, which are formed on the circumferential outer surface of the core bar. The pressure roller 302 is confronted with the fixing roller 301 and pressed by a spring 307 to form a nip between them, and follows in rotation the fixing roller 301 with a frictional contact therebetween.

Figure 16B:
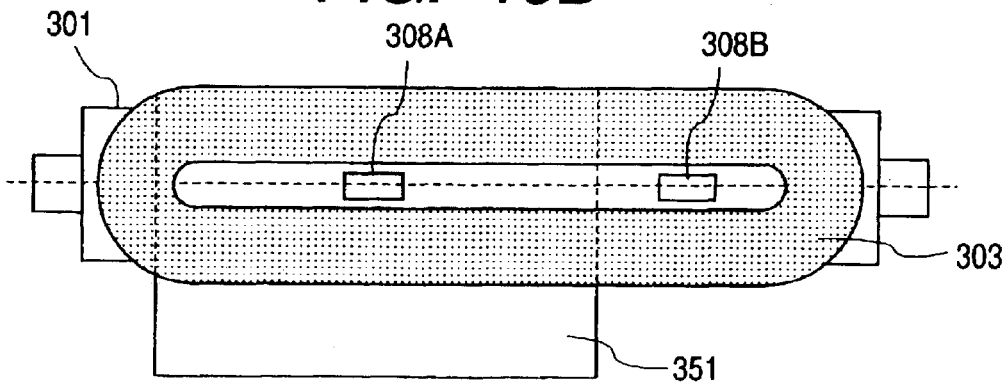
FIG. 16B is a top plan view showing a fixing roller and a coil in the fixing device of FIG. 16A.
Figure 16C:
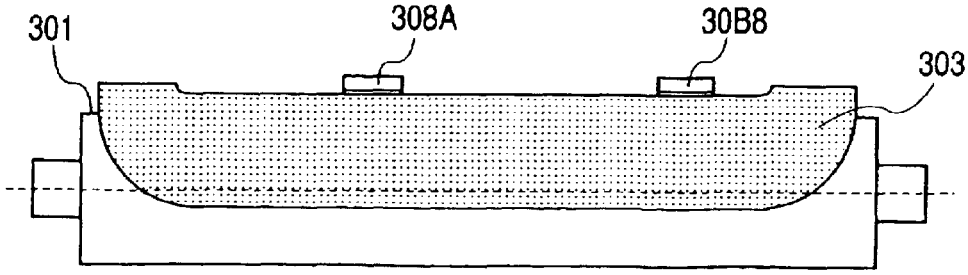
FIG. 16C is a side view of FIG. 16B.

A coil 303, which is for heating the fixing roller 301, is disposed around the fixing roller 301 with a fixed gap formed therebetween. To heat the fixing roller 301, an AC current is fed to the coil 303 and in turn the coil develops an AC magnetic field. The coil 303 covers an area of the circumferential outer surface of the fixing roller 301, which is defined by the half or greater of the circumference of the fixing roller 301. FIG. 16B is a plan view showing a structure of the fixing roller 301 and the coil 303. FIG. 16C is a side view of the same. Since a high frequency current flows through the coil 303, a surface resistance of the coil must be small to lessen the loss by the coil. To satisfy this, a litz wire is used which is formed by twisting a bundle of insulated copper wires. It is formed by twisting a bundle of eight insulated copper wires of 0.5 mm in diameter ($\phi$=0.5 mm).

A recording sheet 305 having a toner image 304 transferred thereto enters the nip between rotating roller pair and receives a nip load, and at the same time it is heated by the fixing roller 301. The toner image 304 being heated is fused on the recording sheet 305. After leaving the nip, it is cooled and fixed on the recording sheet 305. Whether or not the toner image 304 is fixed on the recording sheet 305 depends on fixing temperature, sheet transporting speed, nip width, nip pressure, and nature of toner.

Temperature sensors 308A and 308B are held in contact with or apart from the surface of the fixing roller 301 by a fixed distance, and senses a temperature of the roller and sends it as an electrical signal to a controller 332 through a temperature detector 331. When a temperature of the fixing roller 301 is lower than a control instruction temperature, a controller 332 increases the AC current fed to the coil 303 through the control of an inverter 333, whereby the induction heating is intensified to rise the temperature of the fixing roller 301. Conversely, when the former is higher than the latter, the controller decreases the AC current to the coil 303, and weakens the induction heating to lower the temperature of the fixing roller 301. In this way, the temperature of the fixing roller 301 is kept substantially constant.

Positions at which the temperature sensors 308A and 308B are mounted will be described in two steps of 1) rotational direction and 2) axial direction.

1) Rotational Direction:

As viewed in this direction, the coil 303 covers a large portion of the circumferential outer surface of the fixing roller 301. Accordingly, as shown in FIG. 16B, a space is provided within the coil 303, and temperature sensor 308A and 308B are placed within the space. A magnetic flux 306 developed from the coil 303 flows as shown in FIG. 16A. In the central portion of the coil 303, the magnetic flux 306 is substantially perpendicular to the heating layer of the fixing roller 301. Therefore, an amount of eddy current generated in the vicinity of this portion is relatively small. If the space formed in the central portion of the coil 303 is too small, an efficiency of the eddy current generation is lowered. To avoid this, the space must have a certain size.

Figure 17A:
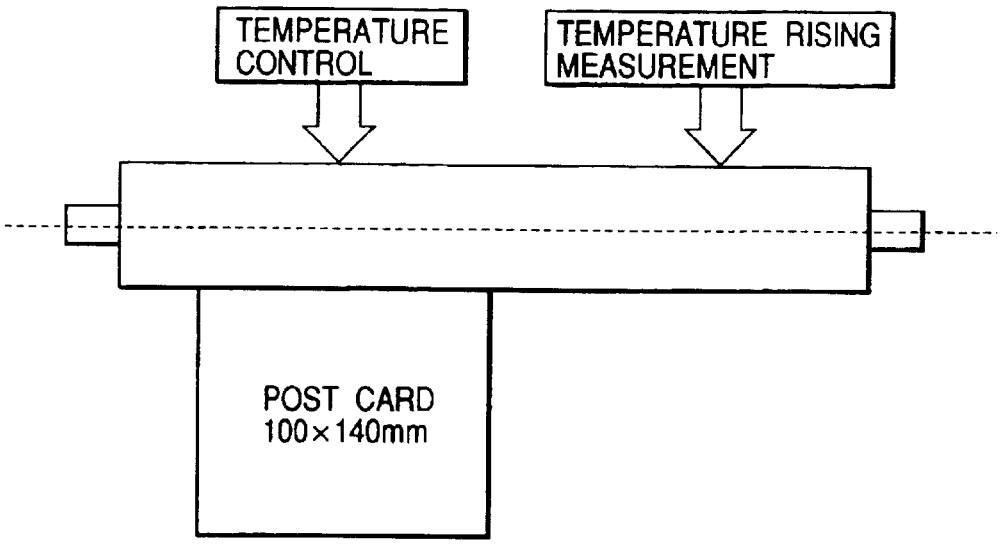
FIGS. 17A and 17B is a diagram showing an example of a fixing roller surface temperature when toner images on small-width recording sheets are successively fixed.
Figure 17B:
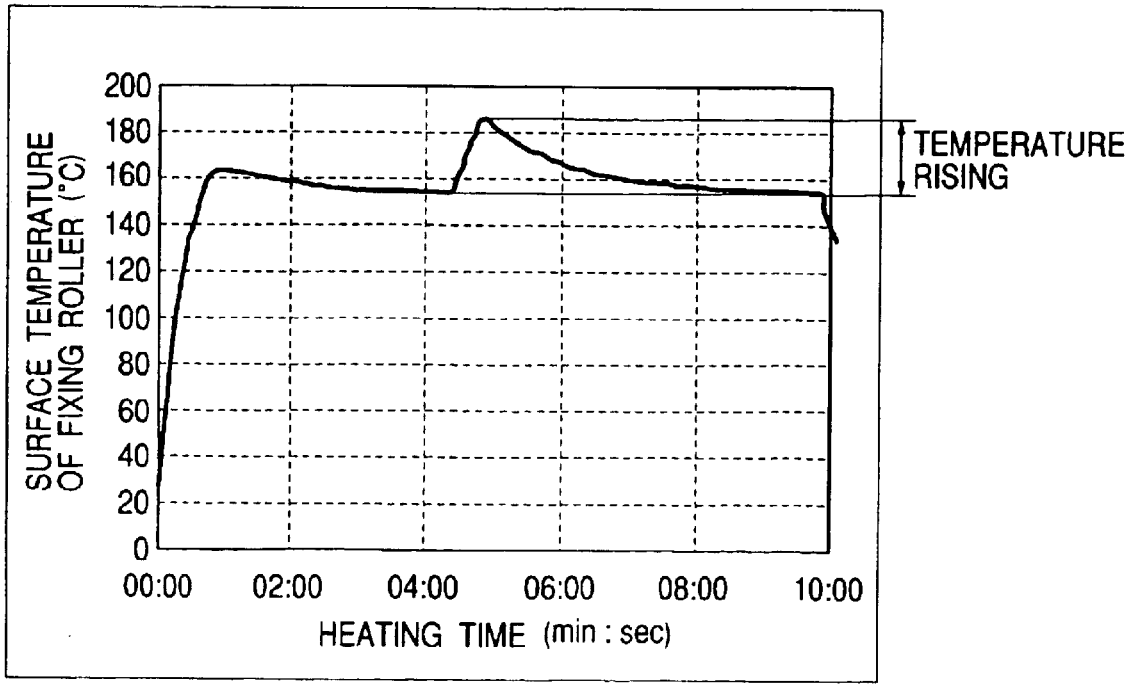

2) Axial Direction:

As viewed in this direction, as shown in FIGS. 16B and 16C, the temperature sensor 308A is placed at a position within a path along which a small-width recording sheet 351 travels. The temperature sensor 308B is placed at a position out of the path. In a temperature control for the recording sheets of the ordinary size and the small size, the roller temperature is controlled to be a fixing temperature Tf by using the temperature sensor 308A. In a case where toner images on the small-width recording sheets 351 are successively fixed, the roller temperature more rises than in the fixing operation for the recording sheet of the ordinary size, as shown in FIGS. 17A and 17B.

For example, the roller temperature is controlled to be within a predetermined value of temperature by using the temperature sensor 308B. Specifically, an upper limit temperature Tmax is set up. The controller carries out an ordinary temperature control when a temperature sensed by the temperature sensor 308B is within the upper limit temperature Tmax. When the sensed temperature exceeds the upper limit temperature Tmax, the controller 332 shifts the temperature control mode to a temperature limiting mode. In this mode, the controller 332 restricts an amount of current fed to the coil 303. In this case, an emergency mode may be used instead. Alternatively, the successive fixing operation of the small-width recording sheets 351 is interrupted, and when the sensed temperature falls to below the upper limit temperature Tmax, the fixing operation is restarted. When temperature rise of 10° C. occurs, it may be judged that the sensed temperature exceeds the upper limit temperature Tmax.

In this embodiment, to heat the fixing roller 301, an eddy current is generated in the heating layer by an AC magnetic field developed from the coil 303.

Here, the eddy current is generated mainly in the portion of the fixing roller 301 covered with the coil 303. This fact implies that such an arrangement of the coil 303 as to cover the fixing roller 301 with the widest possible extension will ensure a stable heating. In this respect, how to select a location at which the temperature sensor 308 is to be placed is significant for the temperature control. To properly sense a temperature on the fixing roller 301, as shown in FIGS. 16B and 16C already referred to, the temperature sensor 308A is preferably placed at a position, which is within the path on and along which the small-width recording sheet 351 passes and is close to the center of the fixing roller 301. This mounting place is most suitable since a temperature in the central space of the coil 303 represents a temperature of the fixing roller 301. Immediately after the recording sheet has passed, heat of the fixing roller 301 is absorbed by the recording sheet 305 and the toner image 304, and its temperature drops. However, the fixing roller is heated by the eddy current after it passes the portion covered with the coil 303. If the temperature sensor is located near the sheet passing portion, the sensor may be damaged with the passing sheet since a chance of the occurrence of a trouble of paper jam or the like is unavoidable. Also in this respect, it is better to place it above the fixing roller 301.

Where toner images on the small-width recording sheets 351 are successive fixed, the portion in which the temperature sensor 308B is placed, which the portion is out of the sheet passing portion, is free from the heat absorption by the recording sheet 305 and the toner image 304. Accordingly, the eddy current is continuously generated and a temperature of that portion rises as shown in FIG. 17B. Since the fixing roller 301 uses a thin metal layer having a small thermal capacity, the heat generated here transfers to the sheet passing portion, however, its heat quantity is small and temperature is easy to rise.

Figure 18A:
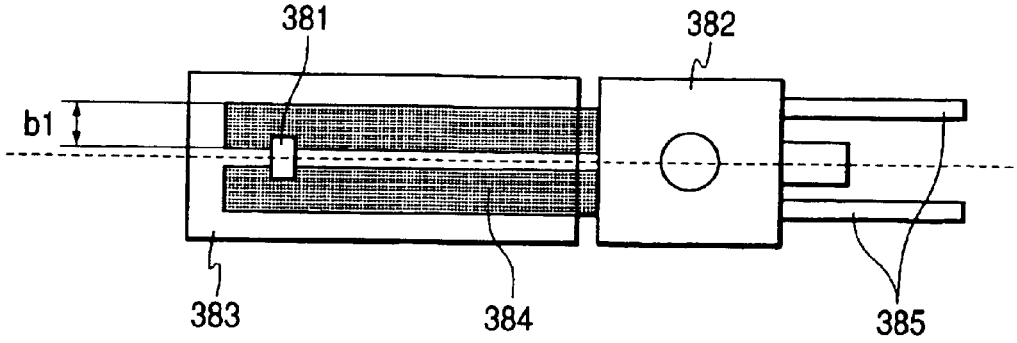
FIG. 18A is a top plan view showing a related temperature sensor.
Figure 18B:
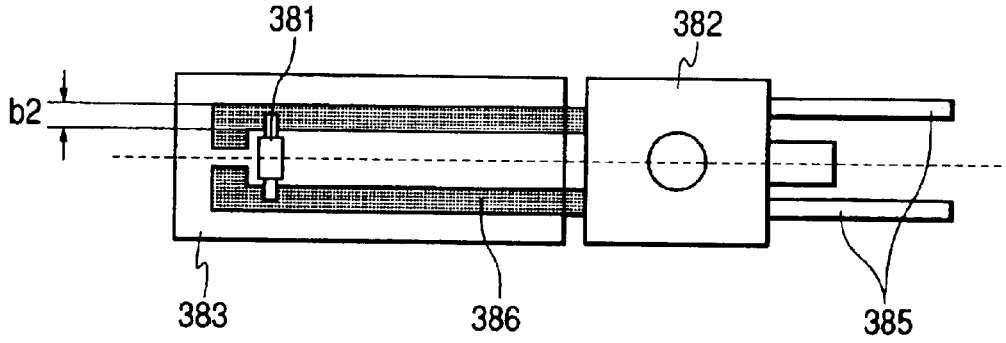
FIGS. 18B and 18C are top plan views showing examples of temperature sensors in the present fixing device.
Figure 18C:
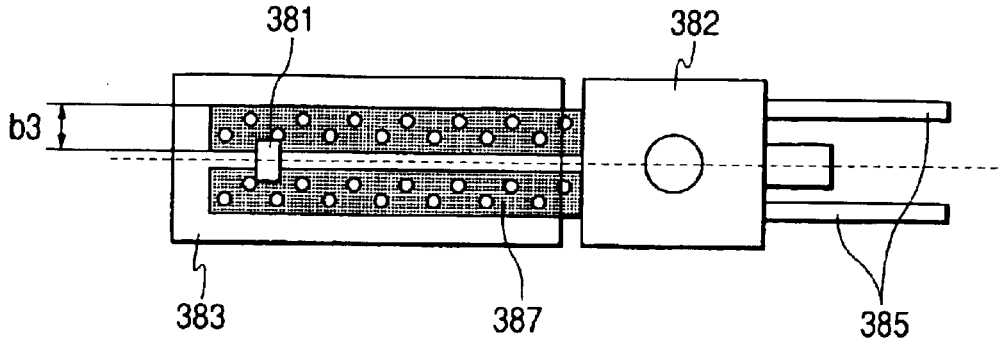

In this case, since the heating layer is thin and the conductor skin effect acts, if a temperature sensor 381, as shown in FIG. 18A, is supported on a support 382 by means of support springs 384 the support springs 384 for the temperature sensor 381 are also heated. Lead lines 385 are lead from the support 382. To cope with this, instead of the related support springs 384 shown in FIG. 18A, support springs 386 shown in FIG. 18B are used which are reduced in thickness and width (b2<b1), whereby an eddy current generating portion is reduced in area. One of the support springs 386 is dimensioned as 0.15 mm or thinner thick and 1.5 mm or shorter wide. With this measure, the heating of the support springs 386 are suppressed. In another alternative shown in FIG. 18C, the dimensions of the support springs 387 remain unchanged (b3=b1), and a number of small holes are formed in the support springs 387 by etching or the like. Thus, the measure to reduce the eddy current generating area or to prevent the eddy current from being generated by using a nonconductive material may be taken. The heating of the support springs 387 can be suppressed when the measure is taken.

Of course, the configuration discussed in connection with this embodiment can be applied to the configuration according to the first to third embodiments.

A fifth embodiment of the invention will be discussed below.

Figure 19:
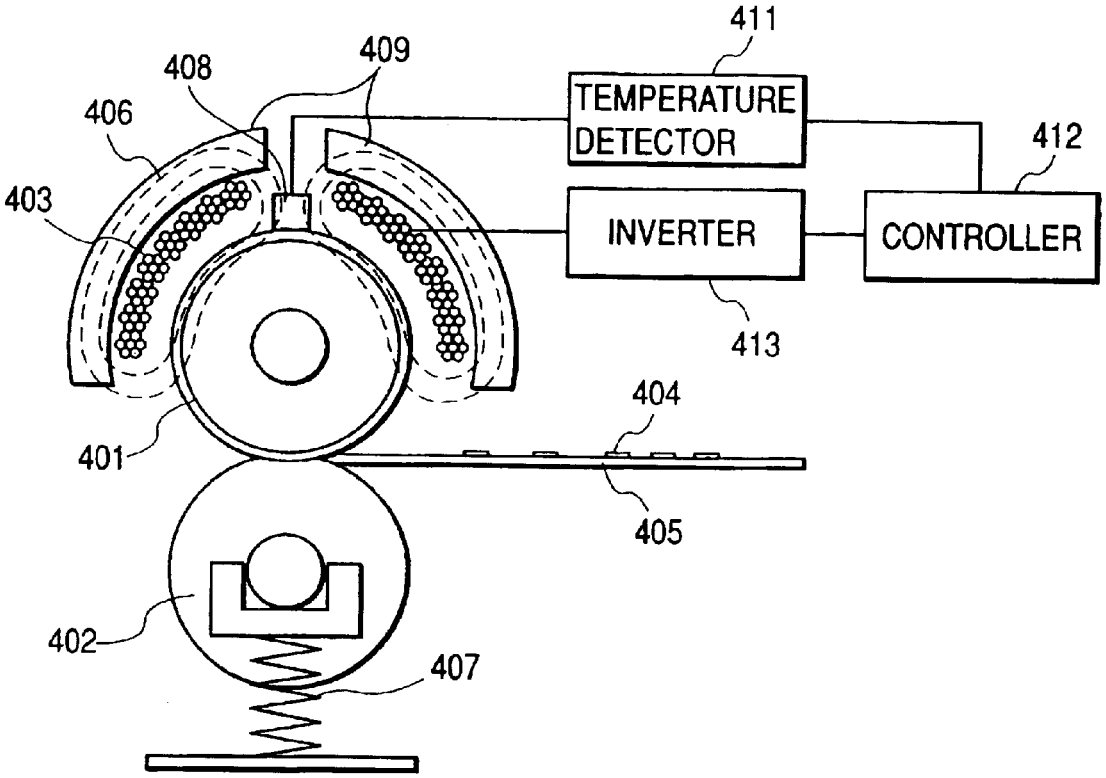
FIG. 19 is a diagram showing a schematic configuration of a fixing device according to a fifth embodiment of the present invention.

In FIG. 19, each of a fixing roller 401 and a pressure roller 402 includes a core bar which enable the fixing roller to rotate, and is rotatably supported at both ends by means of bearings. The fixing roller 401 is coupled to gears and a belt for transmission of a rotational torque, and is rotated at a fixed angular velocity by a motor. An elastic layer for forming a nip is layered on the circumferential outer surface of the core bar of the fixing roller 401. A heating layer and a release layer are further layered on the circumferential outer surface of the elastic layer. The pressure roller 402 is formed with the core bar, and an elastic layer and a release layer. A nip load is applied to the fixing roller 401 being confronted with the pressure roller 402, by springs 407 which are coupled to both ends of the pressure roller by way of levers, to thereby form a nip between them, and follows in rotation the fixing roller 401 with a frictional contact therebetween. Those springs 407 are designed so as to develop equal loads.

A coil 403, which is for heating the fixing roller 401, is disposed around the fixing roller 401 with a fixed gap formed therebetween. To heat the fixing roller 401, an AC current is fed to the coil 403 and in turn the coil develops an AC magnetic field (reference numeral 406 denoted a magnetic flux from the coil 403). The coil 403 covers an area of the circumferential outer surface of the fixing roller 401, which is defined by the half or greater of the circumference of the fixing roller 401. Since a high frequency current flows through the coil, a surface resistance of the coil 403 must be small to lessen the loss by the coil. To satisfy this, a litz wire is used which is formed by twisting a bundle of insulated copper wires. It is formed by twisting a bundle of eight insulated copper wires of 0.5 mm in diameter ($\phi$=0.5 mm).

Yokes 409 are disposed on the circumferential outer surface of portions where an magnetomotive force by the coil 403 is weak, to thereby equalize a temperature distribution in the fixing roller 401. In this embodiment, those yokes 409 are disposed at both ends of the circumferential outer surface of said coil 403.

A recording sheet 405 having a toner image 404 transferred thereto enters the nip between rotating roller pair and receives a nip load, and at the same time it is heated by the fixing roller 401. The toner image 404 being heated is fused on the recording sheet 405. After leaving the nip, it is cooled and fixed on the recording sheet 405. Whether or not the toner image 404 is fixed on the recording sheet 405 depends on fixing temperature, sheet transporting speed, nip width, nip pressure, and nature of toner.

A temperature sensor 408 is held in contact with or apart from the surface of the fixing roller 401 by a fixed distance, and senses a temperature of the roller and sends it as an electrical signal to a controller 412 through a temperature detector 411. The controller 412 carries out a control (PI control, PID control) through an inverter 413 so as to reduce a difference between a control instruction temperature and an actually sensed temperature of the fixing roller 401. Specifically, when a temperature of the fixing roller 401 is lower than a control instruction temperature, the controller 412 increases the AC current fed to the coil 403 through the control of an inverter 413, whereby the induction heating is intensified to rise the temperature of the fixing roller 401. Conversely, when the former is higher than the latter, the controller 412 decreases the AC current to the coil 403, and weakens the induction heating to lower the temperature of the fixing roller 401. In this way, the temperature of the fixing roller 401 is kept substantially constant.

Figure 20A:
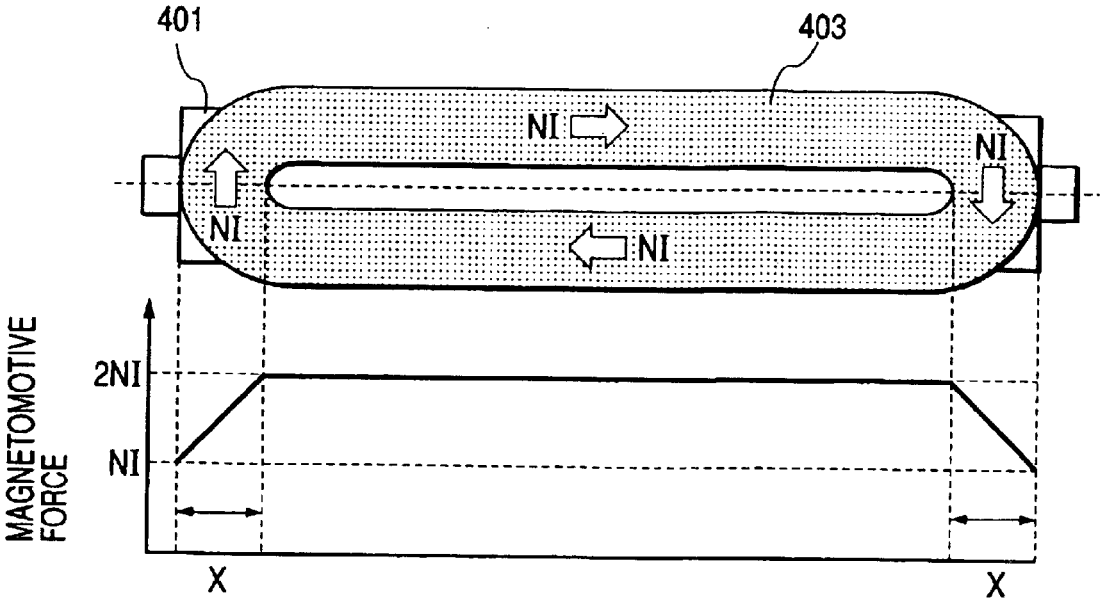
FIG. 20A is a diagram showing a distribution of magnetomotive force of a coil in the fixing device.

In this embodiment, the fixing roller 401 takes a structure including a core, an elastic layer, a conductive heating layer, and a release layer. Accordingly, the heat generated by the conductive heating layer is less lost through the heat transferring to both ends thereof, and the heat transferred to the underlayer of the elastic layer is relatively small in quantity. Where the coil 403 of an NI ampere turn is disposed covering the circumferential outer surface of the fixing roller 401 as shown in FIG. 20A in a state that a fixed gap is present therebetween, a magnetomotive force is 2NI in the center region of the coil between both the ends, and is reduced to NI at both ends (X regions). A factor, which causes the non-uniformity of the temperature distribution in the fixing roller 401, depends on a heat distribution of the heat from the heat source, which is profiled based on this magnetomotive force reduction.

Figure 20B:
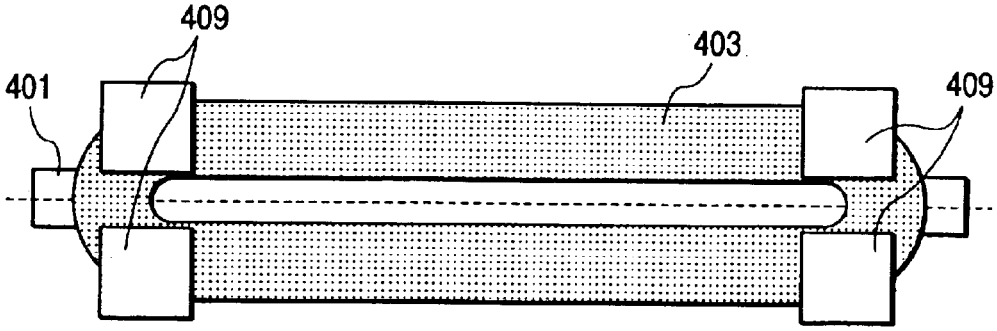
FIG. 20B is a top plan view showing an arrangement of yokes on the coil.
Figure 20C:
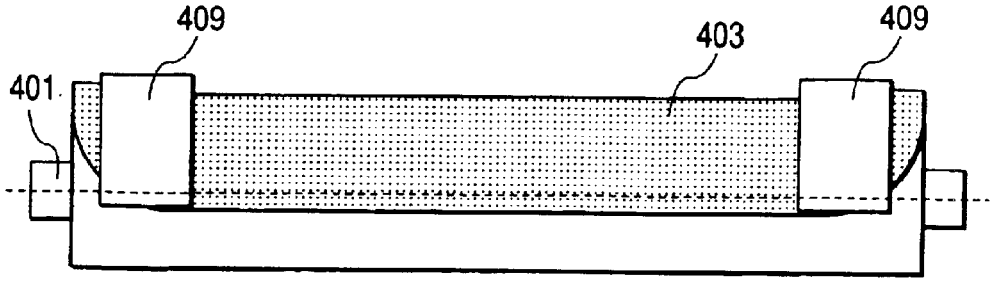
FIG. 20C is a side view of FIG. 20B.

Each yoke 409 serves as a magnetomotive force equalizer (temperature equalizer), and is disposed covering both ends of the fixing roller 401 at which a magnetomotive force of the coil 403 lowers. FIG. 20B is a top view showing a structure of the coil with the yokes attached thereto, and FIG. 20C is a side view showing the same. In this embodiment, with provision of the yokes 409, the uniformity of the heat distribution of the head generated is enhanced, and the thermal capacity of the heating layer is reduced. With provision of the elastic layer layered on the underside thereof, the heat loss by the transferring of the heat generated in the heating layer is reduced. As a result, the quantity of the heat transferring to the flange, bearings and structure members is reduced. Consequently, the uniformity of the temperature distribution in the fixing roller 401 is enhanced.

Figure 21A:
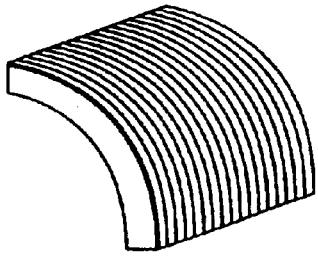
FIGS. 21A to 21D show examples of the yokes.
Figure 21B:
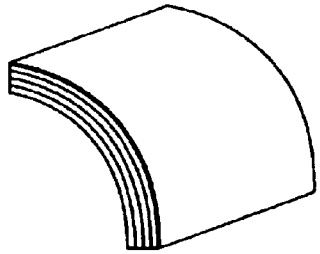
Figure 21C:
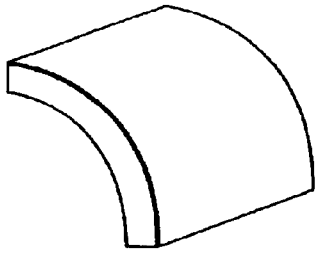
Figure 21D:
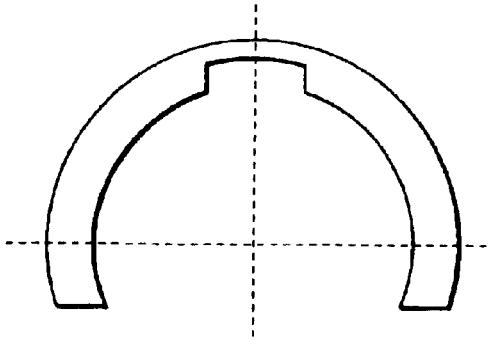

The yoke 409 may take various forms as shown in FIGS. 21A to 21D. A yoke shown in FIG. 21A has a structure whose lamination extends in the axial direction of the fixing roller 401. A yoke shown in FIG. 21B has a structure whose lamination extends in the thick direction. A yoke shown in FIG. 21C has a structure of the bulk type. In those types of yokes, a couple of yokes are disposed on both sides of the circumferential outer surface at each end of the coil 403 as viewed in the longitudinal axis thereof, as shown in FIG. 20B. Those paired yokes may be coupled into a unit yoke as shown in FIG. 21D. A material and a structure of the yoke must be free from generation of the eddy current. Otherwise, the yoke itself will be heated. A soft ferrite of good resistivity p and large permeability is suitable for the yoke 409. A bulk by laminating silicon copper plates each of 0.35 mm or 0.5 mm thick is also suitable for the same.

Figure 22:
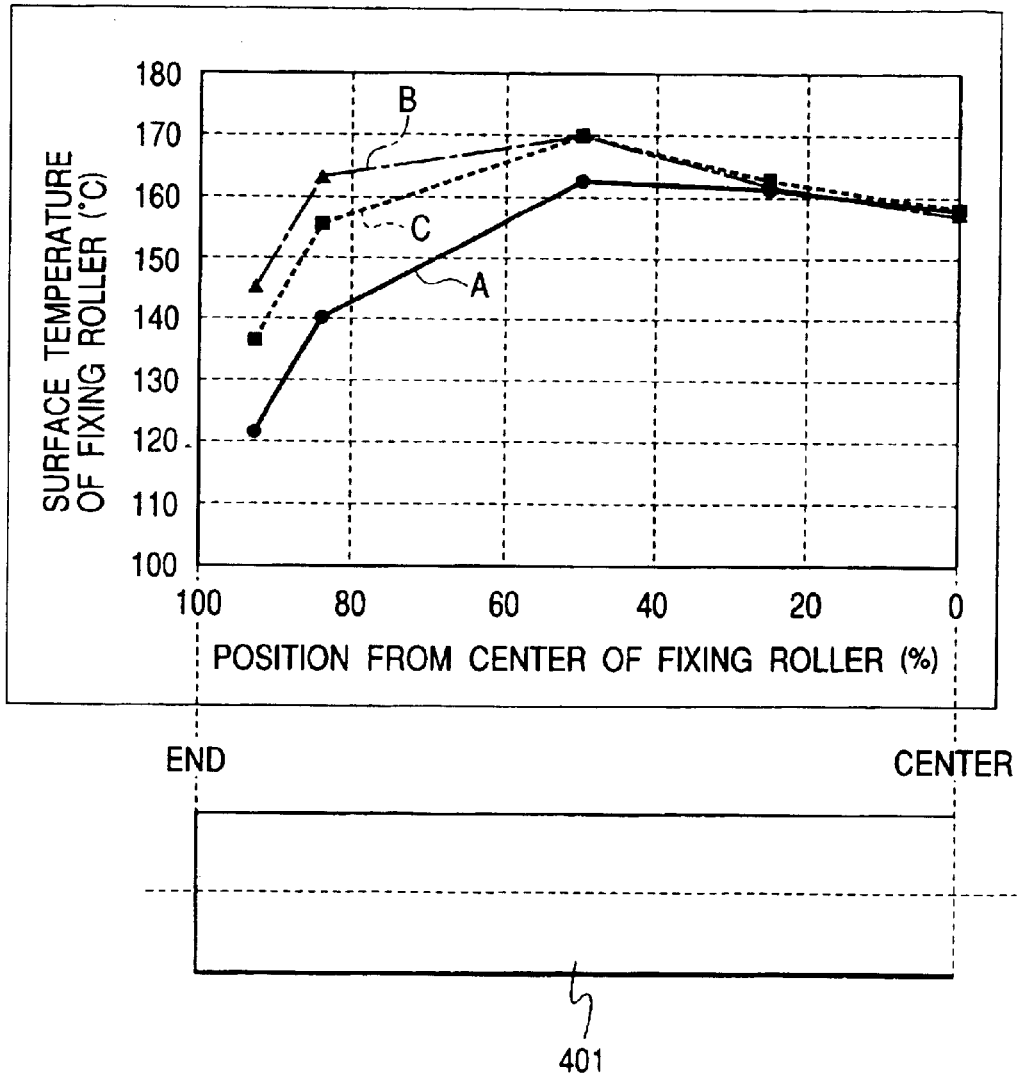
FIG. 22 is a graph showing improvements of a temperature distribution in the fixing roller.

FIG. 22 is a graph comparatively showing variations of a surface temperature of the fixing roller 401 in the following cases: no yokes are attached to the coil 403 (A); the yoke 409 is formed with the silicon steel plates is attached to the coil 403 (B); and the yoke 409 is made of ferrite is attached to the coil 403 (C). In the graph, the abscissa represents a position (%) measured from the center of the fixing roller 401, and the ordinate represents a surface temperature of the fixing roller 401 at each position. In the case not using the yoke, the surface temperature is below 160° C. at a position of about 50% as measured toward the end of the coil 403 from the roller center. In the case using the yoke made of ferrite, the surface temperature is above 160° C. at a position of 70%. In the case using the yoke formed of silicon steel plates, it is also above 160° C. to a position of 85%. Within a range from the center to a position of 85%, the surface temperature drops to 140° C. in the case not using the yoke. When the ferrite yoke is used, the surface temperature is 156° C., substantially equal to that at the center of the fixing roller 401. When the yoke of the silicon steel plate is used, the surface temperature is 164° C., higher than at the center of the fixing roller 401.

Of course, the configuration discussed in connection with this embodiment can be applied to the configuration according to the first to fourth embodiments.

Figure 23:
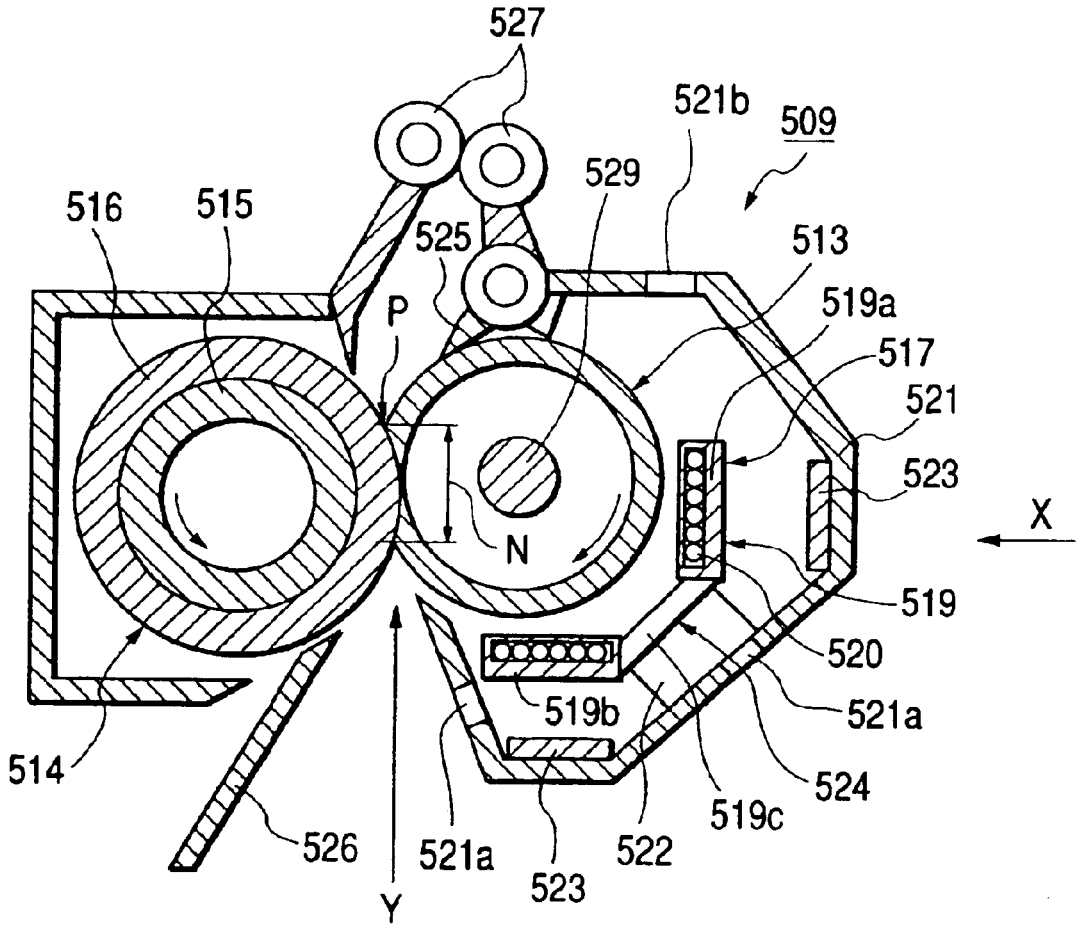
FIG. 23 is a sectional view showing a fixing device according to a sixth embodiment of the invention.
Figure 24:
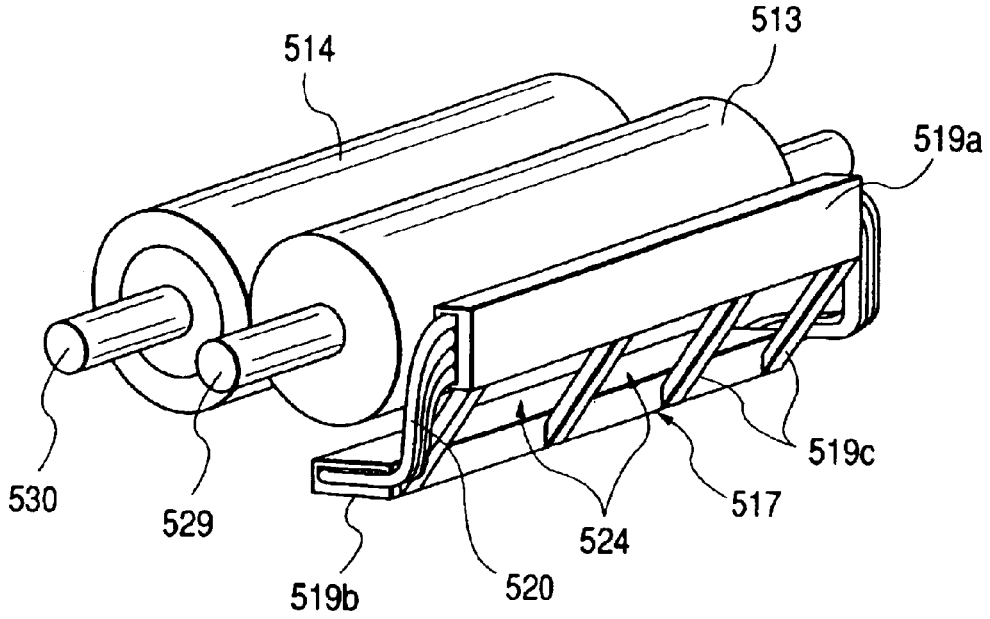
FIG. 24 is a perspective view showing a fixing roller, a pressure roller and a magnetic flux generator in the fixing device of FIG. 23.
Figure 25:
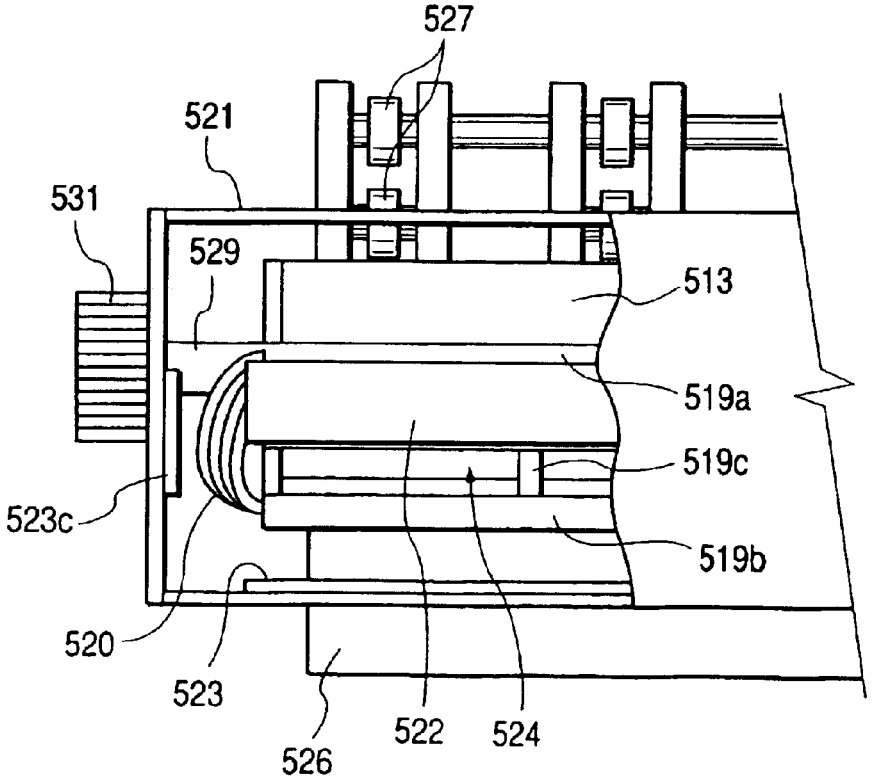
FIG. 25 is a partially broken side view of the fixing device of FIG. 23.
Figure 26A:
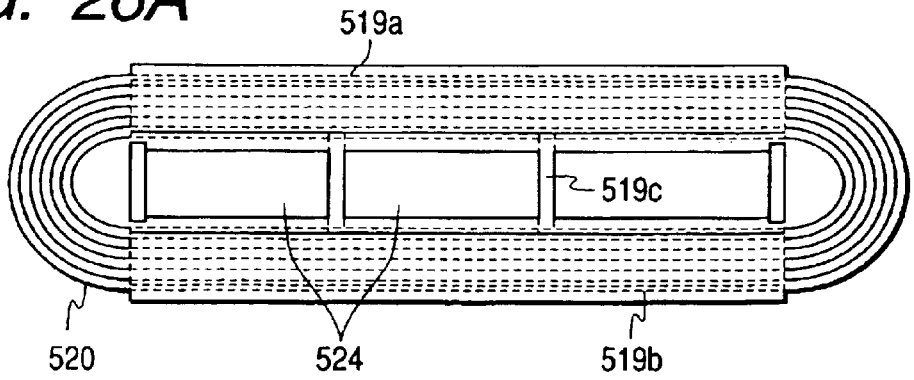
FIG. 26A is a top plan view of the magnetic flux generator.
Figure 26B:
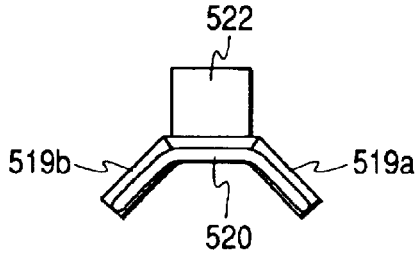
FIG. 26B is a side view of FIG. 26A.
Figure 27:
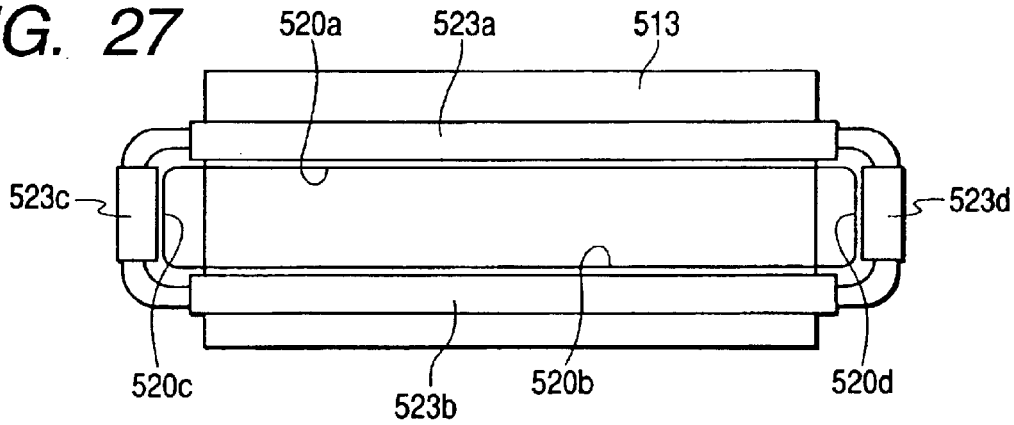
FIG. 27 is a diagram for explaining an arrangement of magnetic capturers.

FIGS. 23 through 27 show a fixing device according to a sixth embodiment of the present invention. FIG. 23 is a cross sectional view. FIG. 24 is a perspective view. FIG. 25 is a side view, partly broken, showing the fixing device as viewed in the direction X in FIG. 23. FIG. 26A is a plan view showing a magnetic field generator. FIG. 26B is a side view showing the magnetic field generator. FIG. 27 is a view showing a layout of flux capturers.

In FIG. 23, a fixing device 509 includes a cylindrical fixing roller 513 made of a magnetic material. A pressure roller 514 is brought into pressing contact with the fixing roller 513. The pressure roller 514 includes a cylindrical rotary shaft 515 and an elastic layer 516 made of silicone rubber or the like, layered over the circumferential outer surface of the cylindrical rotary shaft. When the fixing roller 513 and the pressure roller 514 rotate in the directions, the elastic layer 516 is pressed against the fixing roller 513 to form a nip (pressing interface) N. A magnetic field generator 517 is disposed above the circumferential outer surface of the fixing roller 513 with a predetermined gap being present between them, and at a position located upstream of the most downstream point P of the pressing interface, or the nip N, between the fixing roller 513 and the pressure roller 514 as viewed in a transporting direction Y of the recording medium.

The fixing roller 513 and the magnetic field generator 517 are housed in a casing 521 made of a nonmagnetic material. An exciting coil 520 of the magnetic field generator 517 is held by a coil holder 519 made of an insulating material. The coil holder 519 is fastened to the casing 521 by use of a fastening member 522. The coil holder 519, as shown also in FIGS. 24 to 27, includes two support members 519*a* and 519*b*, which are disposed while being spaced from the fixing roller 513 by a predetermined gap. Those support members 519*a* and 519*b* are interconnected with a plurality of coupling members 519*c*. With such a structure, an air through hole 524 is formed in the central portion of the coil holder 519. The exciting coil 520 is supported between the support members 519*a* and 519*b* while forming an elliptical loop.

Magnetic flux capturers 523 made of ferrite or the like are placed on the casing 521 at positions being confronted with the exciting coil 520. Those flux capturers 523 block a magnetic flux from going outside, and hence prevent it from adversely affecting other electrical circuits. An air inlet hole 521*a* and a vent hole 521*b* are formed in the casing 521. A stripping pawl 525 for stripping the recording medium from the fixing roller 513 is disposed downstream of the nip N in the rotational direction. In the figure, reference numeral 526 denotes a sheet transport guide and 527 denotes a sheet transporting roller.

As shown in FIGS. 24 and 25, the fixing roller 513 and the pressure roller 514 are rotatably supported with rotary shafts 529 and 530, respectively. A drive gear 531 is secured to the rotary shaft 529 of the fixing roller 513, and is rotated by an electric motor, not shown. As shown in FIG. 25, a magnetic flux capturer 523*c* is provided on the casing 521 while being confronted with the side of the exciting coil 520.

FIG. 27 is a view showing a layout of flux capturers. Flux capturers 523*a* and 523*b*, while being arrayed in parallel with the coil, are disposed facing the top surface 520*a* and the lower surface 520*b* of the exciting coil 520, which is looped extending in the axial direction of the fixing roller 513. Flux capturers 523*c* and 523*d*, while being arrayed in parallel with the coil, are disposed facing the side surfaces 520*c* and 520*d*, respectively. Thus, the plurality of flux capturers are disposed in association with the magnetic fluxes of different directions, which are developed from the coil. Accordingly, those members catch the leaking magnetic fluxes with certainty. The flux capturers 523 are fastened to the casing 521, not the coil. Accordingly, there can be secured the air passage of air streams flowing from the air inlet hole 521*a* to the vent hole 521*b* via the air through hole 524. Where the flux capturers are located close to the coil, the magnetic flux to be used for heating the roller will heat the flux capturers. As a result, the heating efficiency of the device is lowered. However, in this embodiment, the flux capturers 523 is located from the coil 520 a distance longer than a distance between the coil 520 and the fixing roller 513. Accordingly, the heating of the fixing roller 513 is effectively performed.

With regard to the magnetic field generator 517, the exciting coil 520 is held on the coil holder 519 while being looped. It extends along the outer surface of the fixing roller 513 while being substantially parallel to the latter, and further is wound along the elongated square or elliptic outer surface of the fixing roller 513. The lines of magnetic force perpendicular to the coil forming plane are caught in a state that those lines are substantially perpendicular to the surface of the fixing roller 513. As a result, an eddy current is generated circulating on the surface of the fixing roller 513, to generate heat. Temperature rises uniformly over a broad range as viewed in the axial direction of the fixing roller 513.

Twisted, covered fine wires are used for the exciting coil 520 in order to secure less magnetic loss. The twisted wires used allows large current to flow therethrough, whereby the heating efficiency is high as compared with that by the small coil. Further, the use of the twisted wires leads to increases of wire rigidity, thereby making it easy to form the coil.

The coil 520 is formed in the form of a single layer such that the individual turns of the coil are radially arrayed while being placed on an identical plane. If those turns of the coil are superimposed in the radial direction of the fixing roller 513, a magnetic force developed from a turn of the coil, which is closer to the roller, cancels a magnetic force developed from a turn of the coil located far from the roller. In the invention, all the turns of the coil are confronted with the roller surface. Accordingly, the magnetic forces developed from those turns of the coil are all received by the roller, so that the heating efficiency is improved. The turns of the exciting coil 520 are densely arranged. The thus formed coil 520 is equivalent to a coil using a thick wire. This accrues to efficient heating, elimination of the canceling of the magnetic forces, and hence heating of the roller uniformly over its surface, which is confronted with the coil.

Further, the air through hole 524 may be formed in the central portion of the magnetic field generator 517. Accordingly, there is no probability that the coil 520 is heated, and resultantly the heating efficiency is reduced. The coil holder 519, the casing 521, the sheet transport guide 526 and the like are all made of nonmagnetic material. If a magnetic material other than fixing roller 513 is present around the magnetic field generator 517, the magnetic force concentrates on the magnetic material, and it is locally heated to be high in temperature. In the embodiment, since the member adjacent to the magnetic field generator 517 is made of non-magnetic material, an abnormal magnetic concentration does not occur, a uniform heating is ensured, and other members are not heated. Hence, the fixing roller 513 is efficiently heated.

Operations of the invention will be described hereunder. A controller, not shown, is operated to feed current to the exciting coil 520. An AC magnetic field is developed between the exciting coil 520 and the fixing roller 513. An eddy current is inductively generated in the magnetic fixing roller 513 placed in the AC magnetic field. The current is transformed into Joule heat through the resistance of the metal per se. Thus, the fixing roller 513 is self-heated to be high in temperature. The temperature rises in the fixing roller 513 while rotating. When the roller temperature rises to a predetermined degree, a temperature sensor (not shown) senses it and outputs an electrical signal. Upon receipt of the output signal, the controller carries out such a control that a surface temperature of the fixing roller 513 is kept at a predetermined temperature. The recording medium is transported and reaches the fixing roller 513, and then is led to a position between the fixing roller 513 and the pressure roller 514. The recording medium is heated there under pressure, so that toner is fixed on the recording medium.

While a specific embodiment of the present invention has been described, it should be understood that the invention is not limited to the embodiment mentioned above, but it may variously be modified, altered and changed within the true spirits of the invention. In the embodiment mentioned above, the pair of the fixing roller 513 and the pressure roller 514 is substantially horizontally disposed. The transporting direction Y of the recording medium is substantially vertical; it is pointed from top toward bottom. If required, the roller pair may be substantially vertically disposed, and the medium transporting direction is substantially horizontal.

In another modification, the magnetic field generator 517 is disposed above the outer surface of the fixing roller 513 with a predetermined gap therebetween and at a position located downstream of the most upstream end P of the pressing interface, or the nip N, between the fixing roller 513 and the pressure roller 514 as viewed in the medium transporting direction Y. With such an arrangement, no large magnetic field acts on the recording medium and toner on the medium. Accordingly, the toner image is not disarranged. Most of the magnetic field generated is directed to the fixing roller. As a result, the adverse effect of the magnetic field on other units is eliminated. Further, a heat transfer time is secured after the heating operation. Accordingly, a temperature difference, which is caused at the heating position, is reduced at the fixing position. In this respect, the fixing performance is improved.

Figure 28:
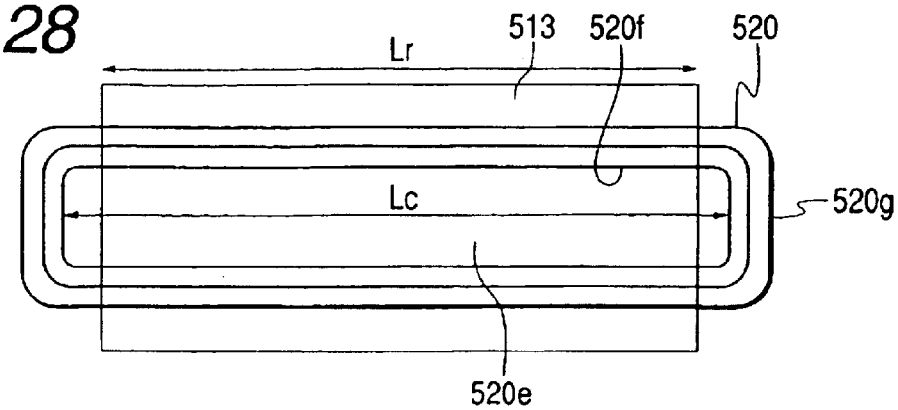
FIG. 28 is a top plan view showing another arrangement of the coil.
Figure 29:
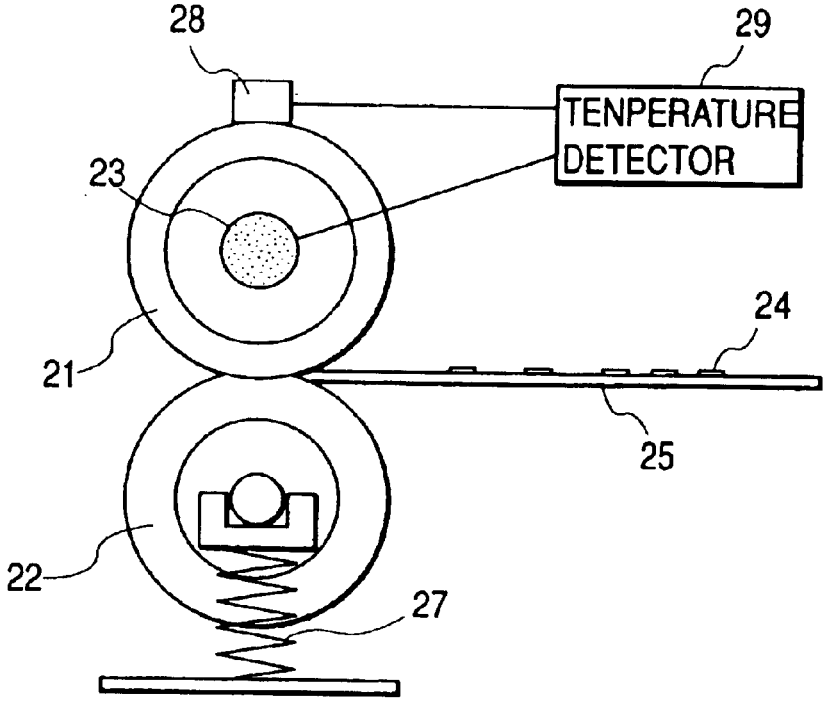
FIG. 29 is a diagram showing a related fixing device which uses a halogen lamp as a heating source.
Figure 30:
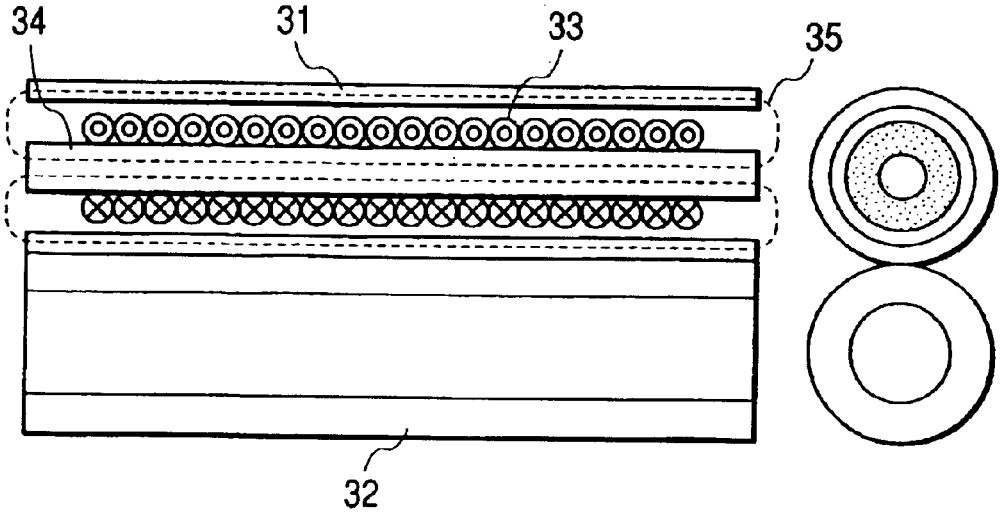
FIG. 30 is a diagram showing a related fixing device in which a coil is held therein and a fixing sleeve is inductively heated.
Figure 31A:
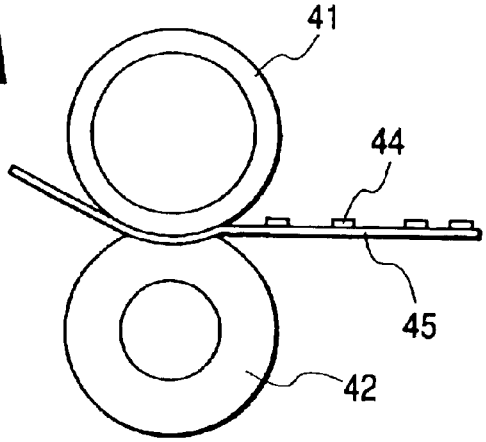
FIGS. 31A to 31C are diagrams for explaining the formation of nips.
Figure 31B:
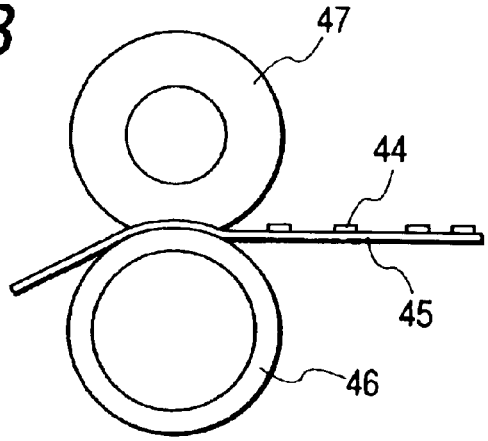
Figure 31C:
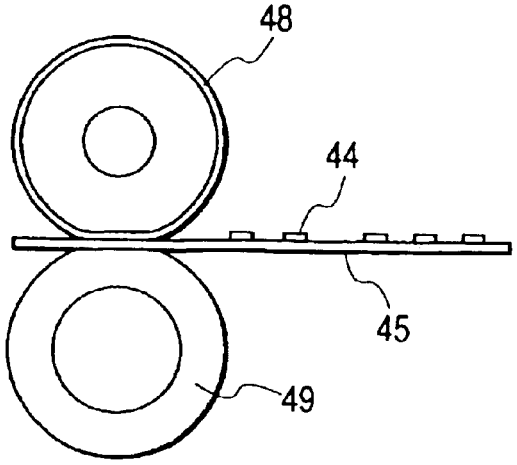

A still another modification of an arrangement of the exciting coil 520 is shown in FIG. 28. In the figure, the exciting coil 520 includes a central space 520*e* defined by a rectangular or looped wire, long sides 520*f* extending in parallel with and in the axial directions of the fixing roller 513, and short sides 520*g* extending in the directions orthogonal to the axial directions of the fixing roller 513. A length Lc of the long side 520*f* of the central space 520*e* is selected to be longer than the axial length Lr of the fixing roller 513.

With such an arrangement, a profile of the magnetic flux distribution in the fixing roller 513 is equalized at both ends of the fixing roller 513 as viewed in the axial direction of the roller. Presence of the central space 520*e* promotes the flow of the air stream through the central portion of the exciting coil 520. Accordingly, the fixing roller 513 is heated uniformly. Cooling of the short sides of the exciting coil 520 is also promoted. This leads to increase of the heating efficiency.

What is claimed is:

1. A fixing device, comprising:

a fixing roller and a pressure roller, for forming a nip therebetween to fix a recorded image onto a recording sheet provided into the nip;

a coil, for providing alternating magnetic field with respect to the fixing roller to inductively heat the fixing roller, the coil including a plurality of coil segments arranged in an axial direction of the fixing roller, and being connected in a manner of either forward connection or alternate connection; and a controller for determining either the forward connection or the alternate connection such that an heating efficiency due to the induction heating has a larger value.

2. The fixing device as set forth in claim 1, wherein each of the coil segments is formed by spirally coiling a litz wire.

3. The fixing device as set forth in claim 1, wherein the coil is formed by alternately laminating insulative sheets and coil segment layers in which each of the coil segments is formed by spirally coiling a conductive film.

4. The fixing device as set forth in claim 1, wherein the controller includes a one-chip voltage resonating inverter.

5. A fixing device, comprising:

a fixing roller and a pressure roller, for forming a nip therebetween to fix a recorded image onto a recording sheet provided into the nip;

a coil, for providing alternating magnetic field with respect to the fixing roller to inductively heat the fixing roller, the coil including a plurality of coil segments arranged in an axial direction of the fixing roller, and being connected in a manner of either forward connection or alternate connection; and a controller for changing the number of coils excited, in accordance with a size of a recording sheet provided into the nip.

6. The fixing device as set forth in claim 5, wherein each of the coil segments is formed by spirally coiling a litz wire.

7. The fixing device as set forth in claim 5, wherein the coil is formed by alternately laminating insulative sheets and coil segment layers in which each of the coil segments is formed by spirally coiling a conductive film.

8. The fixing device as set forth in claim 5, wherein the controller includes a one-chip voltage resonating inverter.

9. A fixing device, comprising:

a fixing roller and a pressure roller, for forming a nip therebetween to fix a recorded image onto a recording sheet provided into the nip, the fixing roller formed by laminating a first elastic layer, a heating layer and a release layer in this order around a core bar;

a coil disposed at an outer peripheral region of the fixing roller, for providing alternating magnetic field with respect to the fixing roller to inductively heat the fixing roller;

a temperature sensor for detecting temperature of the fixing roller; and a controller for controlling the temperature of the fixing roller by adjusting alternating current supplied to the coil, in accordance with the temperature detected by the temperature sensor.

10. The fixing device as set forth in claim 9, wherein a second elastic layer is laminated between the heating layer and the release layer.

11. The fixing device as set forth in claim 9, wherein the heating layer is provided as a pipe member made of metal and having a thickness of 20–200 $\mu$m.

12. The fixing device as set forth in claim 9, further comprising an auxiliary roller which is abutted against at least the fixing roller to support the nip formation of the pressure roller.

13. The fixing device as set forth in claim 9, wherein the coil covers substantially more than the half of an outer periphery of the fixing roller.

14. The fixing device as set forth in claim 9, wherein 20–100 kHz of alternating current is supplied to the coil to generate the magnetic field.

15. The fixing device as set forth in claim 9, wherein the core bar and the heating layer of the fixing roller is electrically connected.

16. The fixing device as set forth in claim 9, wherein the pressure roller is formed by laminating an elastic layer and a release layer in this order onto a core bar.

17. The fixing device as set forth in claim 16, wherein a thermal capacity of the fixing roller is larger than a thermal capacity of the pressure roller.

18. The fixing device as set forth in claim 9, wherein the temperature sensor is disposed at an inner space defined by the coil while being facing with an outer surface of the fixing roller with a gap in between.

19. The fixing device as set forth in claim 18, wherein the temperature sensor is supported by a spring member to which a treatment for suppressing eddy current generation thereon is applied.

20. The fixing device as set forth in claim 19, wherein a thickness of the spring member is 0.15 mm or less, and a width of the spring member is 1.5 mm or less.

21. The fixing device as set forth in claim 19, wherein the spring member is provided with a plurality of apertures.

22. The fixing device as set forth in claim 19, wherein the spring member is made of non-conductive material.

23. The fixing device as set forth in claim 18, wherein the temperature sensor includes a first sensor facing a position on the fixing roller at which a recording sheet having a predetermined width passes through, and a second sensor facing a position on the fixing roller at which the recording sheet does not pass through.

24. The fixing device as set forth in claim 23, wherein the controller control the temperature of the fixing roller so as to fall within a predetermined temperature range, with reference to the detected result of the first sensor; and wherein the controller lowers the temperature of the fixing roller, with reference to the detected result of the second sensor.

25. The fixing device as set forth in claim 24, wherein the controller limits the current supplied to the coil when the temperature of the fixing roller exceeds a predetermined upper limit value.

26. The fixing device as set forth in claim 24, wherein the controller limits the current supplied to the coil when a rising amount of the temperature of the fixing roller exceeds a predetermined upper limit value.

27. The fixing device as set forth in claim 24, wherein the controller interrupts the fixing operation when the temperature of the fixing roller exceeds a predetermined upper limit value.

28. The fixing device as set forth in claim 24, wherein the controller interrupts the fixing operation when a rising amount of the temperature of the fixing roller exceeds a predetermined upper limit value.

29. The fixing device as set forth in claim 9, further comprising a plurality of yokes disposed on an outer periphery of the fixing roller at a region in which an magnetomotive force of the coil is lower than a predetermined value.

30. The fixing device as set forth in claim 29, wherein the yokes are disposed at both longitudinal ends of the fixing roller.

31. The fixing device as set forth in claim 29, wherein each of the yokes is formed by laminating silicon steel plates.

32. The fixing device as set forth in claim 29, wherein each of the yokes is provided as a bulk made of soft ferrite.

* * * * *